US007959037B2

(12) United States Patent
Ophardt et al.

(10) Patent No.: US 7,959,037 B2
(45) Date of Patent: Jun. 14, 2011

(54) SEVERABLE PISTON PUMP

(75) Inventors: Heiner Ophardt, Vineland (CA); Ali Mirbach, Issum (DE)

(73) Assignee: Gotohti.Com Inc., Beamsville Ontario (CA)

( * ) Notice: Subject to any disclaimer, the term of this patent is extended or adjusted under 35 U.S.C. 154(b) by 1427 days.

(21) Appl. No.: 11/436,194

(22) Filed: May 18, 2006

(65) Prior Publication Data

US 2006/0261092 A1 Nov. 23, 2006

(30) Foreign Application Priority Data

May 19, 2005 (CA) ..... 2507914
May 16, 2006 (CA) ..... 2547044

(51) Int. Cl.
*B67D 7/06* (2010.01)
*B65D 88/54* (2006.01)

(52) U.S. Cl. ..... 222/321.9; 222/321.1

(58) Field of Classification Search ..... 222/180, 222/181.1, 181.2, 182, 386, 321.1, 321.7, 222/321.8, 321.9, 181.35, 181.3
See application file for complete search history.

(56) References Cited

U.S. PATENT DOCUMENTS

| | | | | |
|---|---|---|---|---|
| 4,993,600 | A * | 2/1991 | Tucker et al. | 222/321.6 |
| 5,165,577 | A * | 11/1992 | Ophardt | 222/181.2 |
| 5,282,552 | A | 2/1994 | Ophardt | |
| 5,489,044 | A | 2/1996 | Ophardt | |
| 5,676,277 | A | 10/1997 | Ophardt | |
| 5,975,360 | A * | 11/1999 | Ophardt | 222/83 |
| 6,409,050 | B1 * | 6/2002 | Ophardt et al. | 222/181.1 |
| 6,540,157 | B2 * | 4/2003 | Ophardt | 239/428.5 |
| 6,601,736 | B2 | 8/2003 | Ophardt | |
| RE40,319 | E * | 5/2008 | Ophardt et al. | 222/181.1 |
| 7,461,762 | B2 * | 12/2008 | Law et al. | 222/190 |

FOREIGN PATENT DOCUMENTS

| | | |
|---|---|---|
| EP | 0 836 824 A2 | 4/1998 |
| WO | WO 00/33969 | 6/2000 |

* cited by examiner

*Primary Examiner* — Kevin P Shaver
*Assistant Examiner* — Stephanie E Williams
(74) *Attorney, Agent, or Firm* — Riches McKenzie & Herbert LLP

(57) ABSTRACT

A piston pump having a piston forming element carrying at an inner end a removable member which becomes secured in a piston chamber forming member and detached from the piston forming element within the piston chamber forming member.

20 Claims, 29 Drawing Sheets

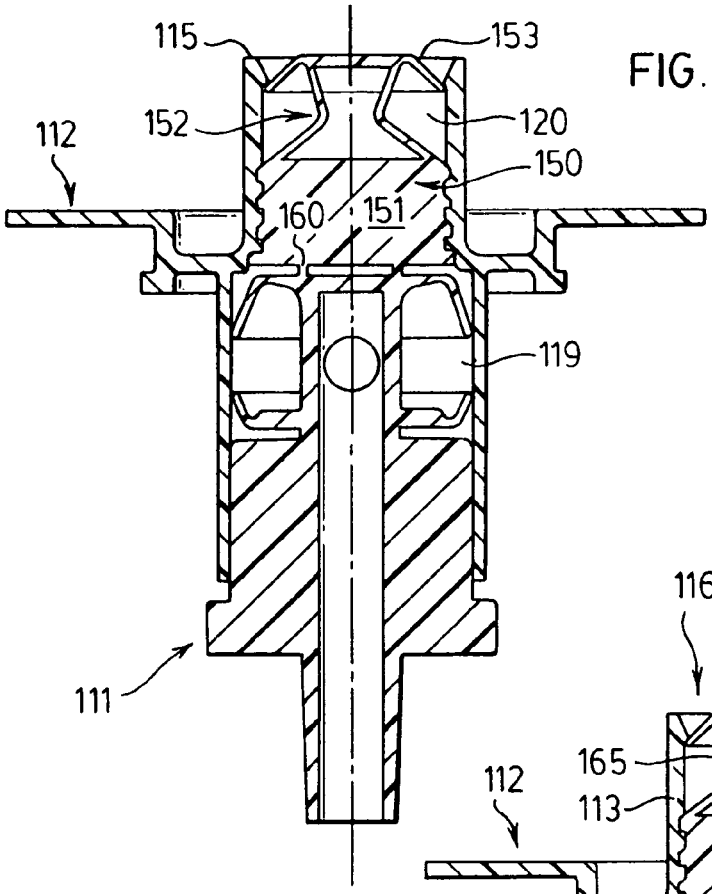
FIG. 14.
FIG. 15.
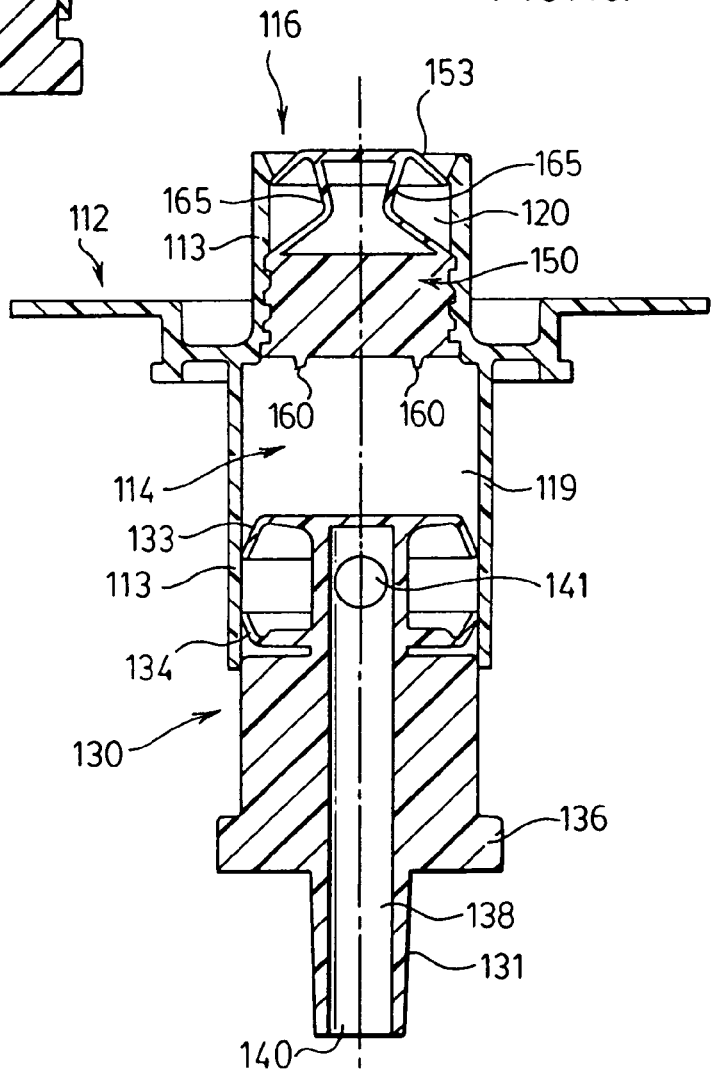

FIG.22
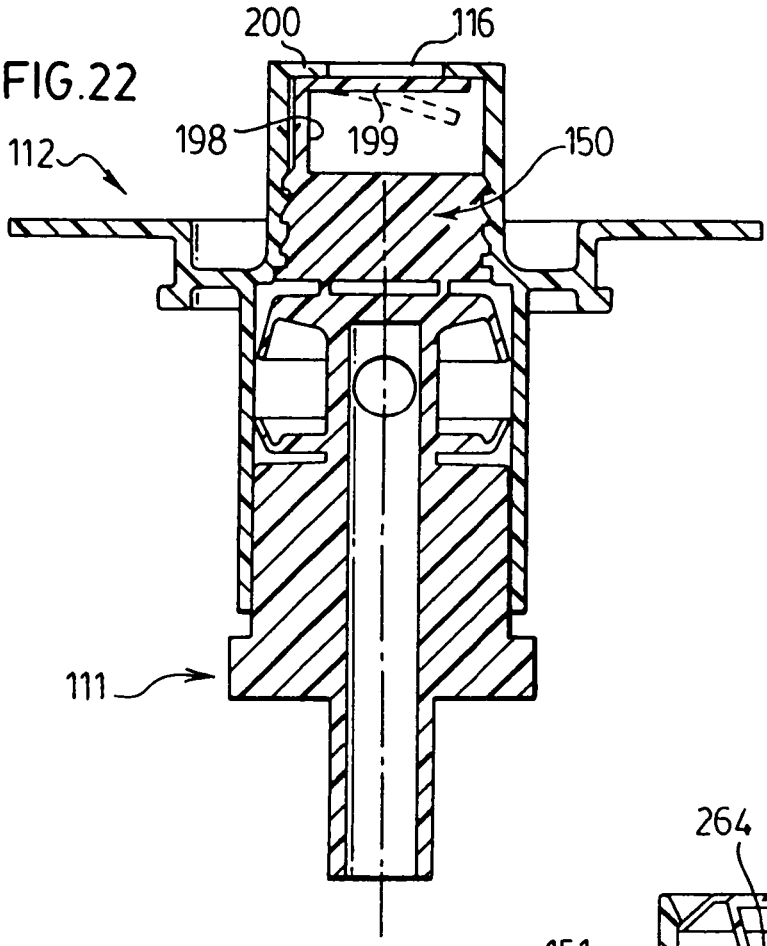
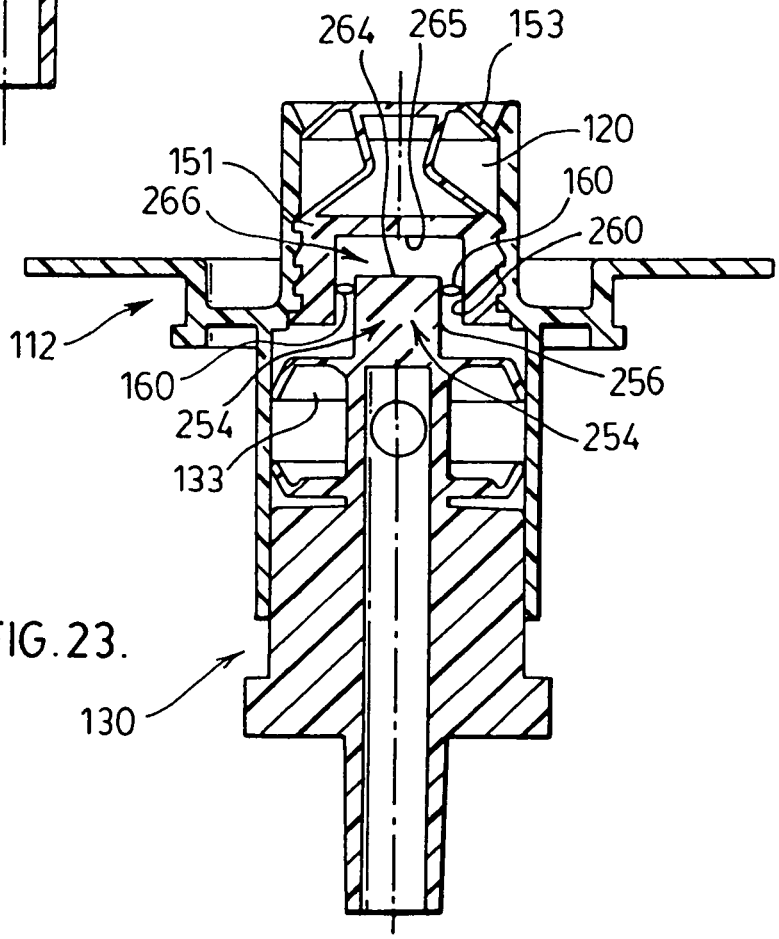
FIG.23.

SEVERABLE PISTON PUMP

SCOPE OF THE INVENTION

This invention relates to piston pumps for fluid dispensers and, more particularly, to a piston pump in which a piston is severable into two components as, for example, to render the pump inoperative and/or to have the severed component serve as a separate element, preferably as a valve.

BACKGROUND OF THE INVENTION

Piston pumps are known in which a piston is reciprocally slidable into and out of an open end of a piston chamber forming member to dispense fluid and in which inwardly of the piston, a one-way valve is provided to restrict flow through the piston chamber. For example, such piston pump assemblies are disclosed in U.S. Pat. No. 5,282,552 to Ophardt, issued Feb. 1, 1994, the disclosure of which is incorporated herein by reference.

A disadvantage of such previously known devices is that the one-way valve provided within the inner end of the piston chamber forming body is a separate element which must be separately manufactured, handled and assembled with increased cost.

Fluid dispensers are known in which fluid in a reservoir container or bottle is to be dispensed from the bottle out of an outlet from the bottle via a pump mechanism secured in the outlet of the bottle. Such pump mechanisms are known in which a piston is coaxially slidable into a piston chamber forming member to dispense fluid from the bottle. Many known piston mechanisms provide an arrangement in which the piston can manually be removed from the piston chamber forming member and the bottle can then be refilled.

Unauthorized refilling of bottles can provide problems as to warranties and ensuring product quality and that product may be dispensed within a suitable product life.

Known pump mechanisms include those disclosed in U.S. Pat. No. 5,676,277 to Ophardt issued Oct. 14, 1997 and U.S. Pat. No. 6,601,736 to Ophardt issued Aug. 5, 2003, the disclosures of which are incorporated herein by reference.

SUMMARY OF THE INVENTION

To at least partially overcome these disadvantages of previously known devices the present invention provides a piston pump with a reciprocally movable piston with an inner portion of the piston being engaged within a piston chamber forming body such that when forces are applied to the piston relative the body an inner portion of the piston severs from the remainder of the piston.

To at least partially overcome this disadvantage of previously known devices, the invention also provides a piston pump having a piston forming element carrying at an inner end a removable member which becomes secured in a piston chamber forming member and detached from the piston forming element with insertion of the piston forming element into the piston chamber forming member and its initial withdrawal outwardly.

An object of the present invention is to provide an improved piston pump with a severable piston.

Another object is to provide a dispensing apparatus including a container and piston pump which is resistant to unauthorized refilling.

Another object is to provide a pump in which a one-way valve is detachably secured to a piston forming element and removably securable in the piston chamber forming member on use.

Another object is to provide a pump assembly with reduced parts and and/or assembly.

Another object is to provide a pump including in use a piston chamber forming member, a piston and a separate one-way valve, however, with the piston and one-way valve being formed initially as a unitary element but as two severable parts.

The present invention provides a pump for dispensing fluids comprising:

a piston-chamber forming member having a chamber about a chamber axis, the chamber having a chamber wall, an inner end, an open outer end, an outlet and an inlet. A piston forming element is received in the piston-chamber forming member axially slidable inwardly and outwardly therein between an extended position and a retracted position in cyclical operation of the pump to draw fluid into the chamber via the inlet and dispense fluid via the outlet. The piston forming element has an outer portion extending outwardly from the chamber through the open outer end, an inner portion in the chamber inwardly from the outer portion, and an intermediate portion coupling the outer portion to the inner portion with the intermediate portion being removably coupled to the inner portion. In one arrangement, the intermediate portion is frangible and breakable to sever the inner portion from the outer portion. In another arrangement, the intermediate portion and the inner portion are two separate elements coupled together in a snap fit relationship and which can be severed as by applying axially directed forces greater than that which can be withstood by the snap fit. Preferably, the piston forming element has a piston catch member and a chamber catch member is carried by the a piston-chamber forming member for engaging the piston catch member when the piston forming element is moved relative the piston-chamber forming member and preventing movement of the piston catch member past the chamber catch member under forces applied to the outer portion which are equal to or greater than forces required to sever the intermediate portion. Preferably, the piston catch member is inwardly from the intermediate portion. In one version, the chamber catch member engages the piston catch member when the piston forming element is slid outwardly relative the piston-chamber forming member and prevents outward movement of the piston catch member past the chamber catch member under axially outwardly directed forces applied to the outer portion which are equal to or greater than axially outwardly directed forces required to separate the intermediate portion from the inner portion. In another version, the chamber catch member engages the piston catch member when the piston forming element is slid inwardly relative the piston-chamber forming member and prevents inward movement of the piston catch member past the chamber catch member under axially inwardly directed forces applied to the outer portion which are equal to or greater than axially inwardly directed forces required to separate the intermediate portion from the inner portion, preferably, with the intermediate portion being severable. In some embodiments, when the inner portion is severed from the outer portion, the pump is rendered inoperative and does not dispense fluid on axially sliding of the piston forming element inwardly and outwardly between the extended position and the retracted position. The inner portion may be a valve mechanism which co-operates with the piston-chamber forming member to substantially prevent flow through the chamber at least one of inwardly and outwardly therepast. This valve mechanism may comprise a piston disc which engages the chamber wall to substantially prevent flow through the chamber at least one of inwardly and outwardly therepast.

In another embodiment, when the inner portion is severed from the outer portion, the pump is rendered operative for dispensing fluid on axially sliding of the piston forming element inwardly and outwardly between the extended position and the retracted position. The inner portion may comprise a valve mechanism which co-operates with the piston-chamber forming member to substantially prevent flow through the chamber at least one of inwardly and outwardly therepast. This valve mechanism may be a one-way valve preventing flow from the chamber inwardly through the inlet.

The present invention provides in one aspect a dispensing apparatus including a fluid containing container and a piston pump for dispensing fluid from an outlet of the container, a piston which is movable between retracted and extended positions to dispense fluids, which piston has a piston inner portion connected to a piston outer portion by a weaken strength, frangible intermediate portion which is broken to sever the piston inner portion from the piston outer portion on forces being applied to the piston outer portion greater than the forces required for normal operation of the pump. In the event that the piston is attempted to be removed from a piston chamber forming member in which the piston is axially slidable, catch element on the piston inner portion engage catch elements on the piston chamber forming member such that axially outwardly applied force come to bear on the frangible intermediate portion breaking the same and severing the piston inner portion from the piston outer portion. The severed piston inner portion preferably remains in the piston chamber forming member preferably blocking fluid flow therethrough in one or both directions, preferably inwardly. Reciprocal movement of the piston forming element from which the piston inner portion has been detached is inoperative to pump fluid.

In another aspect, the present invention provides a pump for dispensing fluids comprising: a piston-chamber forming member having a chamber about a chamber axis, the chamber having a chamber wall, an inner end, an open outer end, an outlet and an inlet, a piston forming element received in the piston-chamber forming member axially slidable inwardly and outwardly therein between an extended position and a retracted position in cyclical operation of the pump to draw fluid into the chamber via the inlet and dispense fluid via the outlet, the piston forming element having: an outer portion extending outwardly from the chamber through the open outer end, an inner portion in the chamber inwardly from the outer portion, an intermediate portion coupling the outer portion to the inner portion, and a piston catch member inwardly from the intermediate portion, the intermediate portion being frangible and breaking to sever the inner portion from the outer portion when an axially outwardly directed breaking force is applied to the outer portion, the breaking force being greater than axially outwardly forces required to slide the piston forming element from the retracted position to the extended position, a chamber catch member carried by the a piston-chamber forming member engaging the piston catch member when the piston forming element is slid outwardly relative the piston-chamber forming member at least as far as the extended position and preventing outward movement of the piston catch member past the chamber catch member under axially outwardly directed forces applied to the outer portion which are equal to or greater than the breaking force, wherein when the inner portion is severed from the outer portion the pump is rendered inoperative and does not dispense fluid on axially sliding of the piston forming element inwardly and outwardly between the extended position and the retracted position.

In another aspect, the present invention provides a pump for dispensing fluid from a reservoir, comprising:

a piston-chamber forming member having a cylindrical chamber, said chamber having a chamber wall, an outer open end and an inner end in fluid communication with the reservoir;

first one-way valve means between the reservoir and the chamber permitting fluid flow through the inner end of said chamber from the reservoir into the chamber;

a piston forming element slidably received in the chamber for reciprocal movement inwardly and outwardly in a cycle having an instroke and an outstroke, the piston forming element accessible for movement relative the piston-chamber forming member through the open end of the chamber;

second one-way valve means between the chamber and an outlet permitting fluid flow from the said chamber out the outlet, the piston forming element carrying a piston head which engages with the chamber wall to (i) in a first stroke, being one of the instroke and the outstroke, create pressure in the chamber between the first one-way valve means and the second one-way valve means thereby closing the first one-way valve means and displacing fluid out the second one-way valve means to the outlet and (ii) in a second stroke, being one of the instroke and the outstroke which is not the first stroke, create a vacuum in the chamber between the first one-way valve means and the second one-way valve means thereby closing the second one-way valve means and drawing fluid into the chamber from the reservoir through the first one-way valve means, the first one-way valve means including a detachment portion which is carried on the piston forming element severably secured thereto preferably by a snap fit or frangible connection member, the detachment portion carrying detachment portion catch means, the piston-chamber forming member carrying chamber catch means in the chamber, the detachment portion catch means and chamber catch means interacting such that on initial sliding of the piston forming element with the detachment portion secured thereto into the chamber in the instroke, the detachment portion catch means and chamber catch means are placed into engagement securing the detachment portion to the chamber in a operative position which renders the first one-way valve means operable and prevents release from such securement of the detachment portion catch means from the operative position under forces applied to the detachment portion catch means through the frangible connection member greater than an identical force which will sever the snap fit or frangible connection member.

BRIEF DESCRIPTION OF THE DRAWINGS

Further aspects and advantages of the present invention will become apparent from the following disclosure taken together with accompanying drawings in which:

FIG. 14 is a cross-sectional side view of the piston forming element and piston chamber forming member of FIG. 13 with the piston forming element in a fully inserted, instroke position;

FIG. 15 is a cross-sectional side view similar to that in FIG. 14 but showing the piston forming element as separated with its detachment portion secured in the piston chamber forming member in an operative position and the piston moved outwardly in an outstroke;

FIGS. 21 and 22 are views the same as FIGS. 11 and 14 but of a seventh embodiment providing an inner one-way flapper valve;

FIG. 23 is a cross-sectional view similar to that shown in FIG. 14 but of a eighth embodiment of the invention with a piston forming element in a fully inserted instroke position;

DETAILED DESCRIPTION OF THE DRAWINGS

Figure 1:
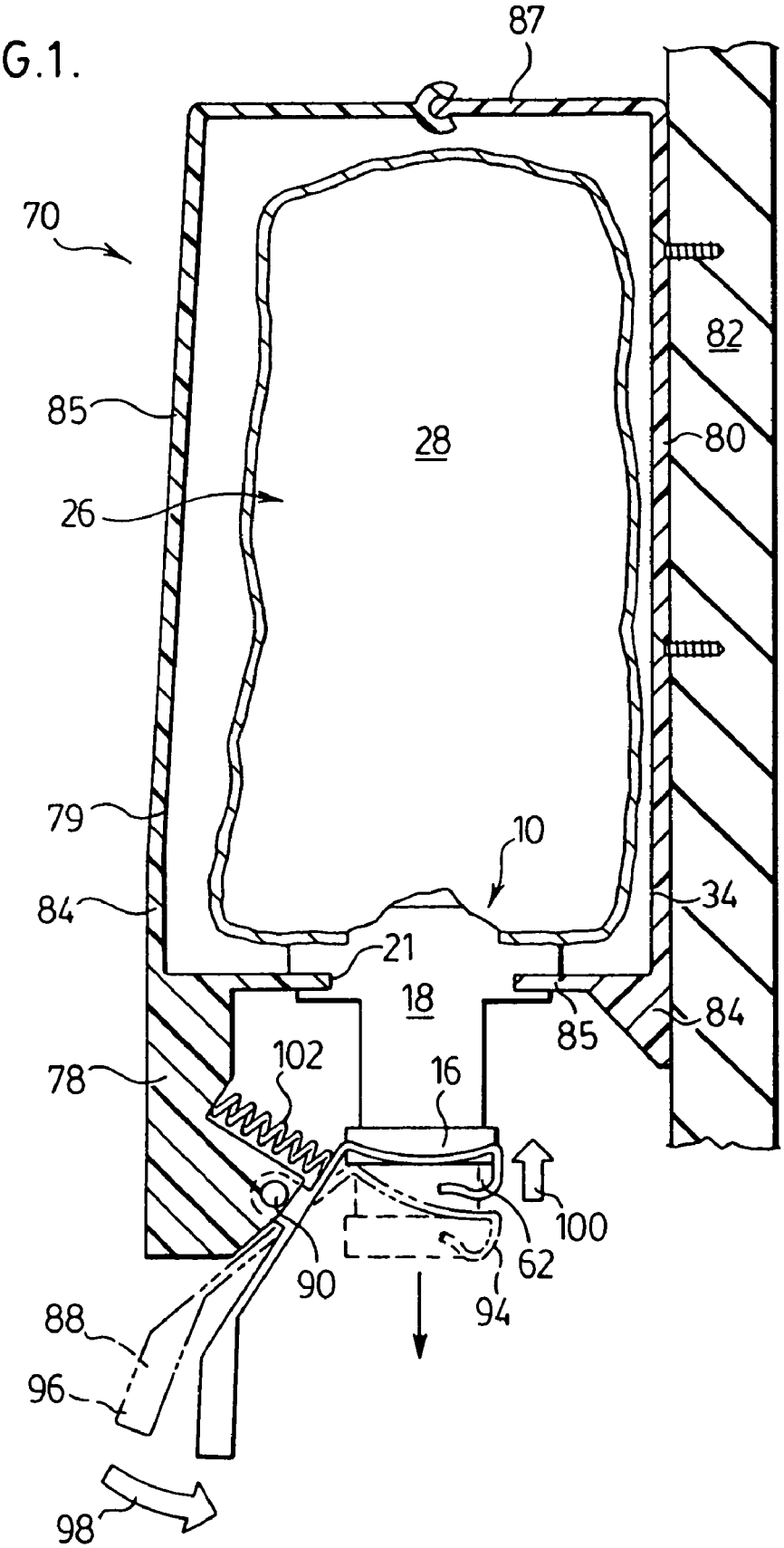
FIG. 1 is a schematic cross-sectional side view through a dispenser in accordance with a first embodiment of this invention.

Reference is made to FIG. 1 which illustrates a dispenser generally indicated as 70 having a housing indicated as 78 to receive and support a removable bottle subassembly comprising a pump assembly 10 and a fluid container 26. Housing 78 is shown with a back plate 80 for mounting the housing to a building wall 82. A bottom support plate 84 extends forwardly from the back plate to receive and support the pump assembly 10 and container 26 as with a support shelf 85 being received in an annular groove 21 about the body 18 of the pump assembly 12. A cover member 85 is hinged to an upper forward extension 87 of the back plate 80 so as to permit replacement of the subassembly of the pump assembly 10 and the bottle 26.

The housing 78 carries at a lower, forward portion thereof an actuating lever 88 journalled for pivoting about a horizontal axis at 90. An upper end of the lever 88 carries a hook 94 to engage an engagement flange of a piston 16 of the pump assembly 12 and couples the lever 88 to the piston 16, such that movement of the lower handle end 96 of the lever from the position shown in solid lines to the position shown in dashed lines, in the direction indicated by arrow 98 slides the piston inwardly in a return, pumping stroke as indicated by arrow 100. On release of the lower handle end 96, spring 102 biases the upper portion of the lever 88 downwardly so that the lever 88 draws piston 16 outwardly to a fully withdrawn position as seen in dashed lines in FIG. 1. Lever 88 and its inner hook 94 are adapted to permit manual coupling and uncoupling of the hook 94 to the piston 16 as is necessary to remove and replace the bottle subassembly comprising the pump assembly 10 and the container 26.

In use of the dispenser 70, once exhausted, the empty container 26 together with its attached pump assembly 10 are removed and a new bottle subassembly of the pump assembly 10 and the container 26 are inserted into the housing.

Figure 2:
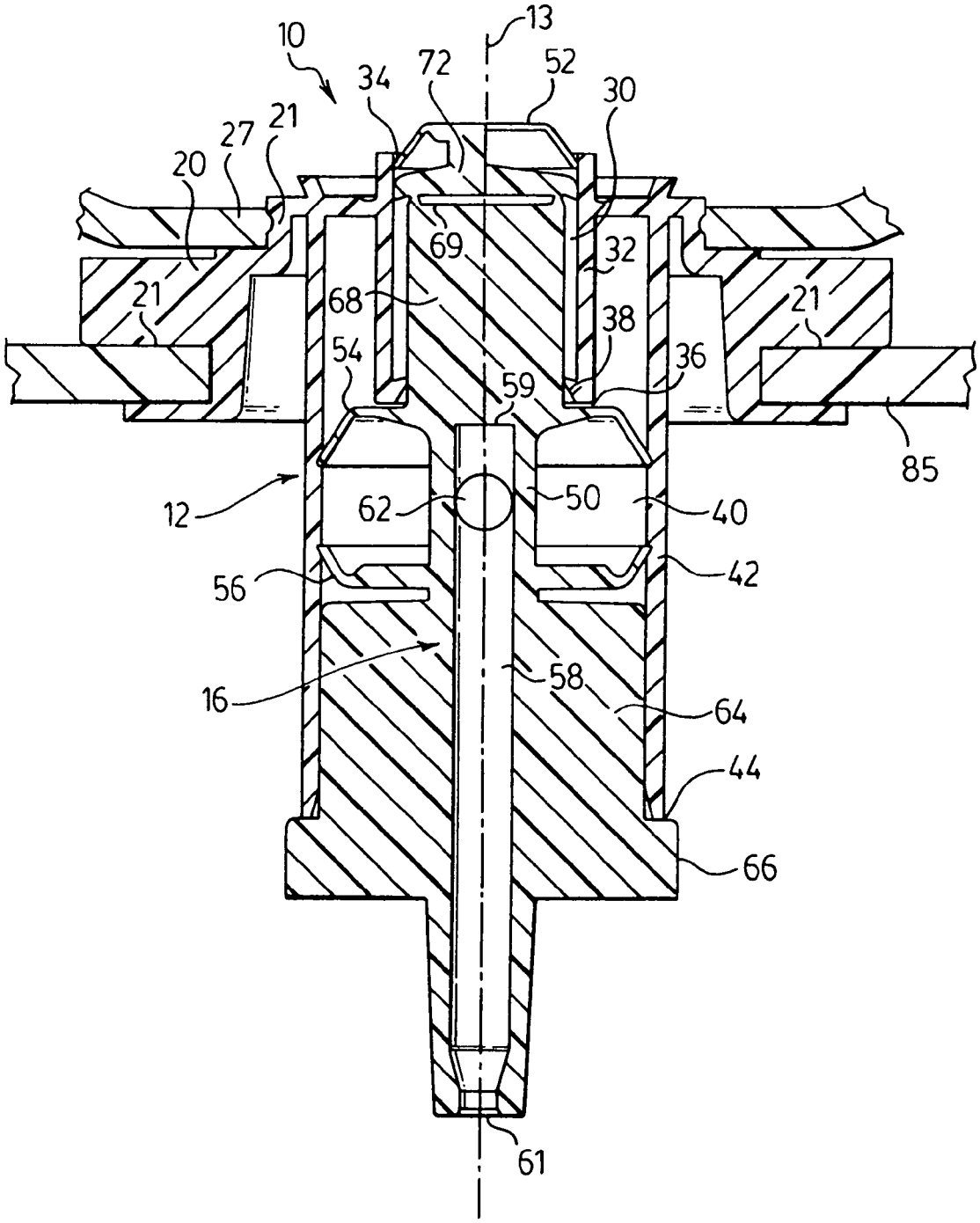
FIG. 2 is an enlarged cross-sectional side view of the pump mechanism shown in FIG. 1 with the piston in a fully retracted position.

The pump assembly 10 is best shown in FIG. 2 as comprising a piston chamber forming body 12 and a piston 16. The body 12 is generally cylindrical in cross-section and symmetrical about its central axis 13. The body 12 has an outer cylindrical hub portion 20 which provides an annular generally cylindrical plug portion 21 to which an annular rim 27 of the container 26 is to be fixedly secured against removal as for example by sonic welding, gluing or by being received in a snap-fit.

The hub portion 20 also carries the radially outwardly directed annular groove 22 to receive the support shelf 85.

The body 12 defines a stepped chamber therein as a first chamber 30 having a cylindrical sidewall 32 and being open at an open axially inner end 34 and open at an axially outer end 36. The sidewall of the inner chamber 30 provides a cylindrical interior surface other than proximate the outer end 36 where an annular catch flange 38 extends radially inwardly.

An outer chamber 40 is also provided having a sidewall 42, and an open axially outer end 44 serving as an inlet to the outer chamber 40. The outer end 36 of the inner chamber 30 opens outwardly into an inner end and inlet to the outer chamber 40.

The sidewall 42 of the outer chamber is cylindrical. The diameter of the inner chamber 30 is less than the diameter of the outer chamber 40.

The piston 16 is coaxially received within the body 12. The piston 16 is generally cylindrical in cross-section about the axis 13. The piston 16 is preferably a unitary element formed entirely of plastic preferably by injection moulding. The piston 16 has a hollow stem 50 extending along the central longitudinal axis of the piston 16.

A circular resilient flexing first disc 52 is located at the innermost end of the piston 16 and extends axially therefrom. The first disc 52 is sized to circumferentially abut the cylindrical sidewall 32 of the inner chamber 30 substantially preventing fluid flow axially outwardly therebetween. The first disc 52 has an elastically deformably edge portion near the sidewall 32 which is adapted to be deformed away from the sidewall 32 so as to permit fluid to flow axially outwardly past the disc 52.

A circular resilient second flexing disc 54 is located on the stem 50 axially outwardly from the first flexing disc 52. The second disc is in the second chamber 40 and is sized to circumferentially abut the cylindrical sidewall 42 of the outer chamber 40 so as to substantially prevent fluid flow inwardly therepast. The second disc 54 has an elastically deformable edge portion which extends radially and axially outwardly.

A third disc 56 is located on the stem 50 axially outwardly of the second disc 54. The third disc 56 is also in the second chamber 40 and is sized to circumferentially abut the cylindrical sidewall 42 of the second chamber 40 substantially prevent fluid flow outwardly therepast.

The piston stem 50 has a hollow central passage 58 extending along the axis of the piston 60 from a closed inner end 59 to an open outlet 61 at the outer end of the piston 16. An inlet 62 is provided through the stem 50 providing via a short radial passageway from between the second disc 54 and third disc 50, communication to the central passageway 58.

Figure 3:
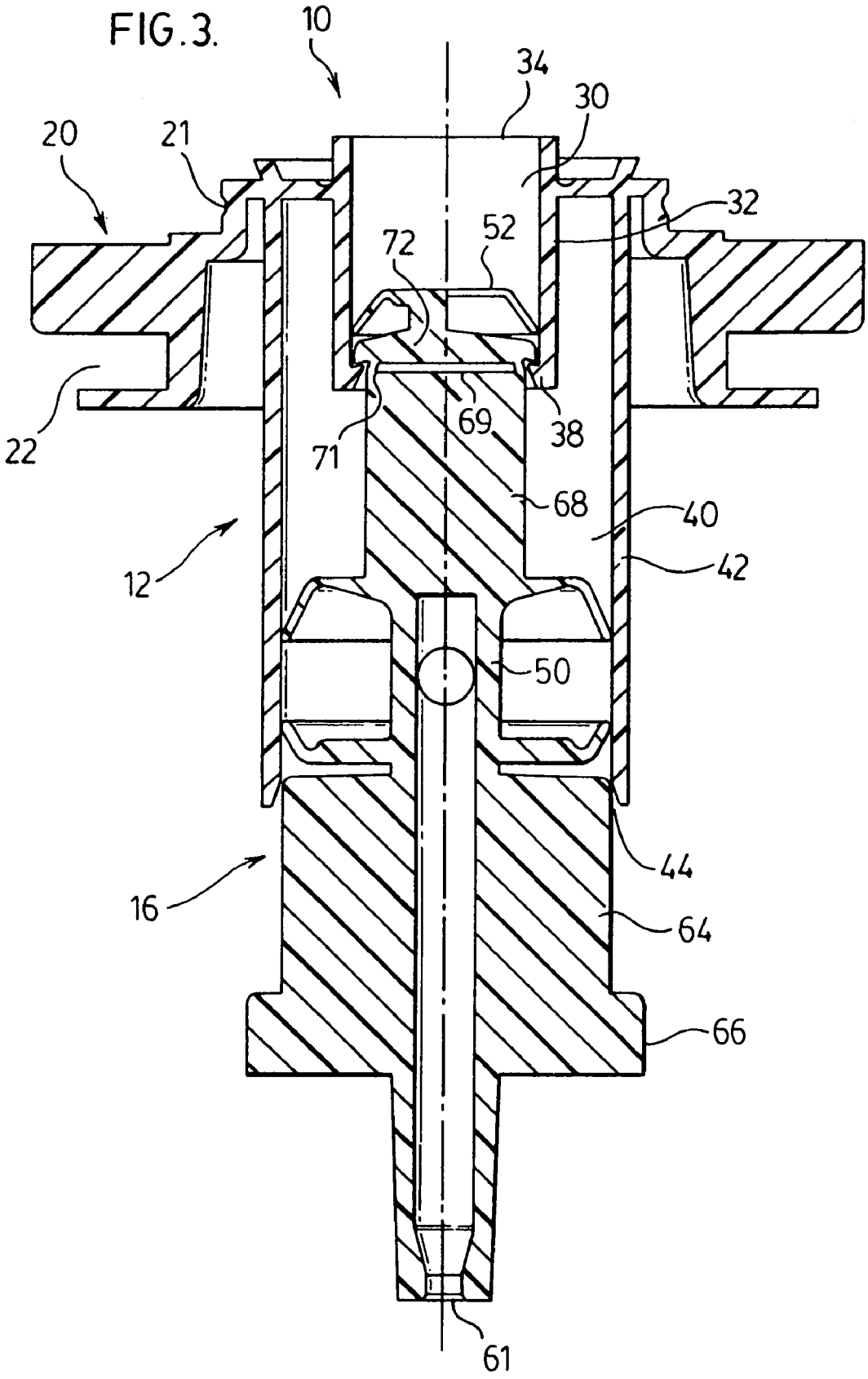
FIG. 3 is a cross-sectional view the same as FIG. 2 however with the piston in a fully extended position.

The pump mechanism 10 is operative to dispense fluid from the interior of the container 26 out the outlet 61 in a cycle of normal operation in which the piston 16 is moved relative to the body 12 from the retracted position shown in FIG. 2 to the extended position shown in FIG. 3 and to then return to the retracted position shown in FIG. 2. In moving in an extension stroke from the retracted position of FIG. 2 to the extended position of FIG. 3, fluid from the container 26 is drawn through the inner chamber 30 into the outer chamber 40 by reason of the volume in the chambers between the first disc 52 and the second disc 54 increasing, creating a vacuum to draw fluid from the container 26 outwardly past the first disc 52. In moving from the extended position of FIG. 3 to the retracted position of FIG. 2, fluid between the first disc 52 and second disc 54 is pressurized and urged outwardly past the deflecting second disc 54 to between the second disc 54 and the third disc 56 and hence via the outlet 62 into the passageway 58 and out of the outlet 61.

Outward of the third disc 56, the stem 50 carries a four axially extending outer webs 64 which are circumferentially spaced and serve to engage the sidewall 42 of the outer chamber 40 and assist in maintaining the piston 16 axially centred in the outer chamber 40. Axially outwardly of the web 64, the stem carries an engagement flange 66 adapted for engagement by the hook 94 of the lever 88 shown in FIG. 1 to move the piston 16 between the extended and retracted positions.

Inwardly of the second disc 54, the stem 50 carries four axially extending inner webs 68 which extend radially from the stem 50 to engage the radially inner periphery of the annular catch flange 38 and assist in maintaining the piston 16 axially centred in the inner chamber 30. In the embodiment illustrated, both the outer webs 64 and the inner webs 68 are provided as four webs, pairs of which are diametrically opposed.

The inner webs 68 each end at axially inward end 69 from which a strut member 71 extends axially to connect each of the four inner webs 68 to a corresponding piston catch member 72 which extends from an inner portion of the stem 50 radially outwardly past the webs 68 and into sliding engagement with the sidewall 32 of the first chamber 30. Each of the piston catch members 72 presents an axially outwardly directed piston catch shoulder 73. The annular catch flange 38 of the first chamber 30 presents an axially inwardly directed chamber catch shoulder. On sliding of the piston 16 to the extended position illustrated in FIG. 3 the piston catch shoulder 73 and the chamber catch shoulder engage to prevent movement of the piston catch shoulder 73 outwardly passed the chamber catch shoulder. The piston catch shoulder 73 has a radially innermost edge which is radially inward of a radially outermost edge of piston catch shoulder.

With the piston 16 in the extended position as illustrated in FIG. 3, if axially directed forces are applied to the piston, the engagement between the piston catch member 72 and the chamber catch flange 38 resists further outward movement of the piston 16 with the axially directed forces being transferred from the engagement flange 66 through the piston 16 to the piston catch member 72 via the four strut members 71.

With the piston member 16 formed as an integral member formed from plastic as by injection moulding, the strut members 71, when subjected to axially outwardly directed forces greater than a breaking force will break such that each of the four inner webs 68 will become severed from its corresponding piston catch member 72. In this regard, the strut members 71 form a frangible intermediate portion of the piston which is intermediate an inner portion 100 including the piston catch member 72 and the first disc 52 and an outer piston portion 102 including, amongst other things, the inner webs 68, second disc 54, third disc 56, outer webs 54 and engagement flange 66.

Figure 7:
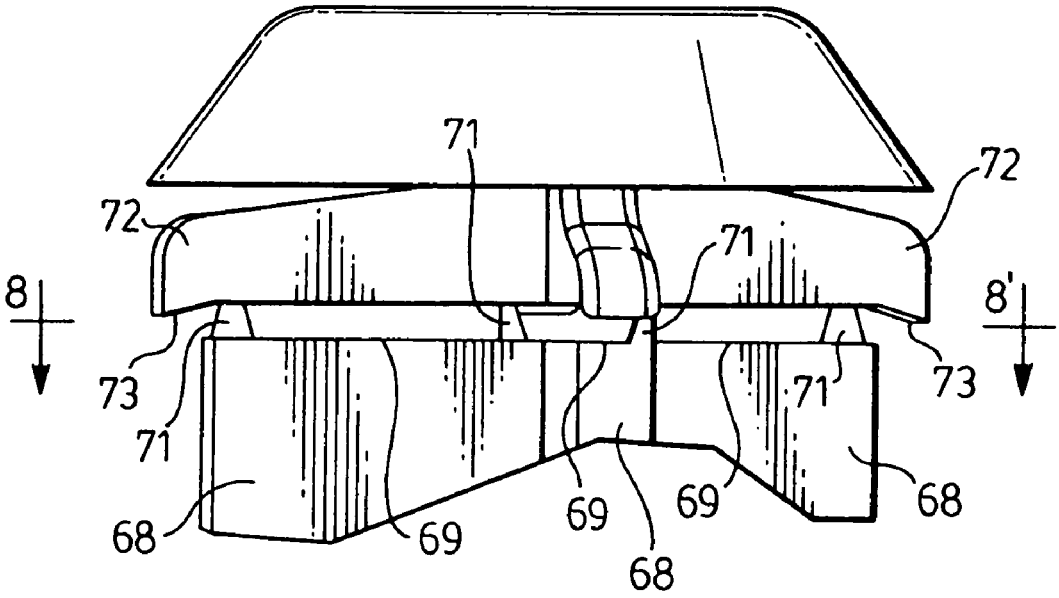
FIG. 7 is an enlarged pictorial view of the inner end of the piston shown in FIG. 6.
Figure 8:
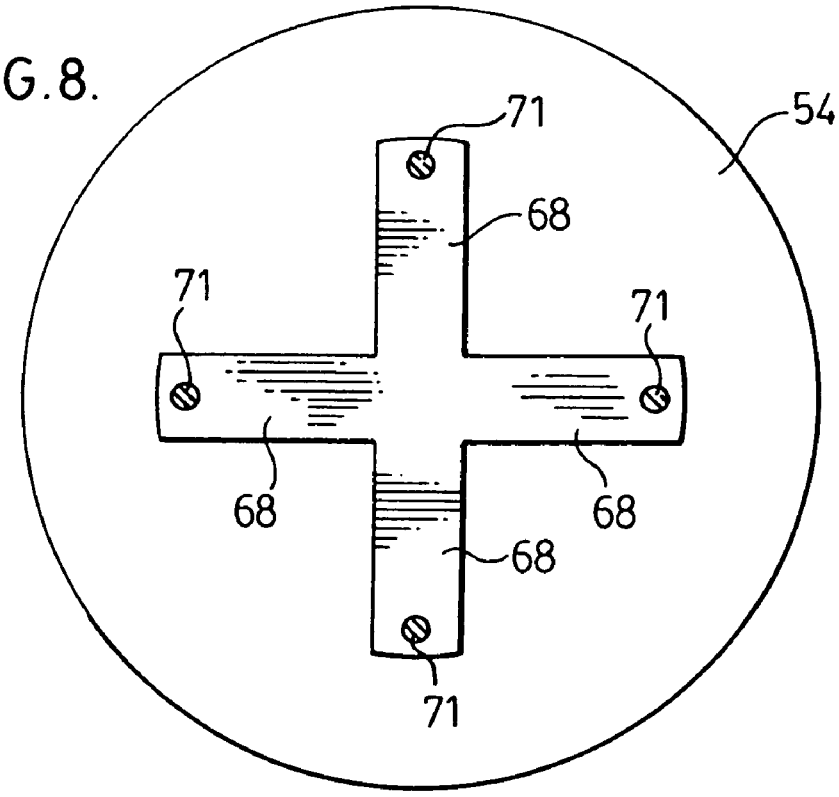
FIG. 8 is a cross-sectional side view along Section line 8-8' in FIG. 7.

Reference is made to FIG. 8 which illustrates a cross-sectional side view along section line 8-8' in FIG. 7, showing the cross-section through each of the four strut members 71 as cross thatched circles since each of the strut-like members are conical. FIG. 8 shows the cross-sectional area represented by the webs 68, which is many times greater than the sum of the cross-sectional areas of the strut members 71.

In the preferred embodiment illustrated, the sum of the cross-sectional areas of the strut members 71 are substantially less than the sum of the cross-sectional area through any other portion of the stem 50 axially outwardly of the strut members 71. Accordingly, on the application of the axially outwardly directed forces to the piston 16 as on the engagement flange 66 axially outwardly from the strut members 71, such forces are applied across the strut members 71. When the piston catch members 72 are prevented from outward movement, applying to the engagement flange 66 a force sufficient will break the frangible strut members 71 and result in severing of the outer portion 102 of the piston from its inner portion 100.

Figure 4:
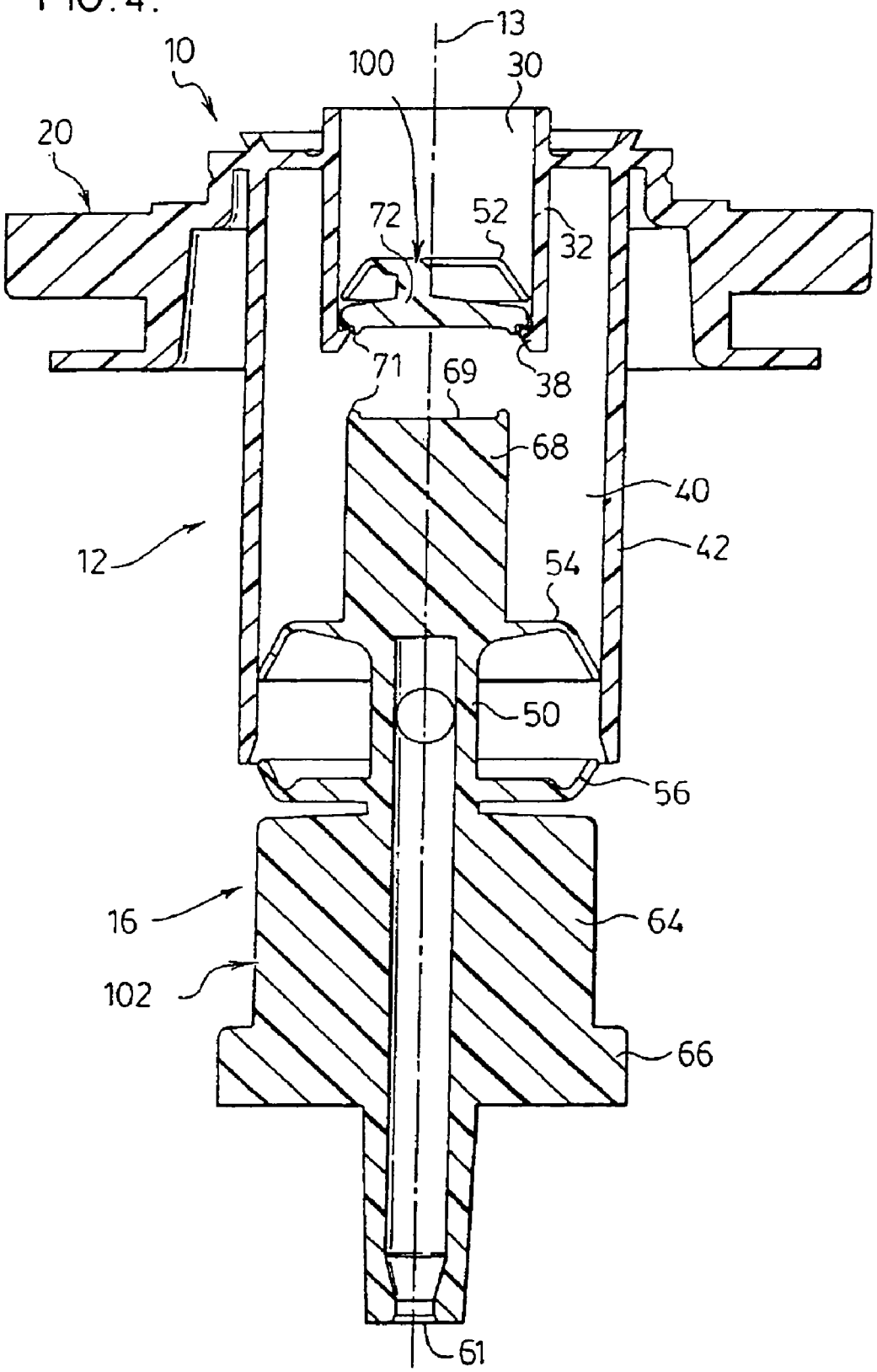
FIG. 4 is a cross-sectional side view of the piston of FIG. 2 showing the piston as severed.
Figure 5:
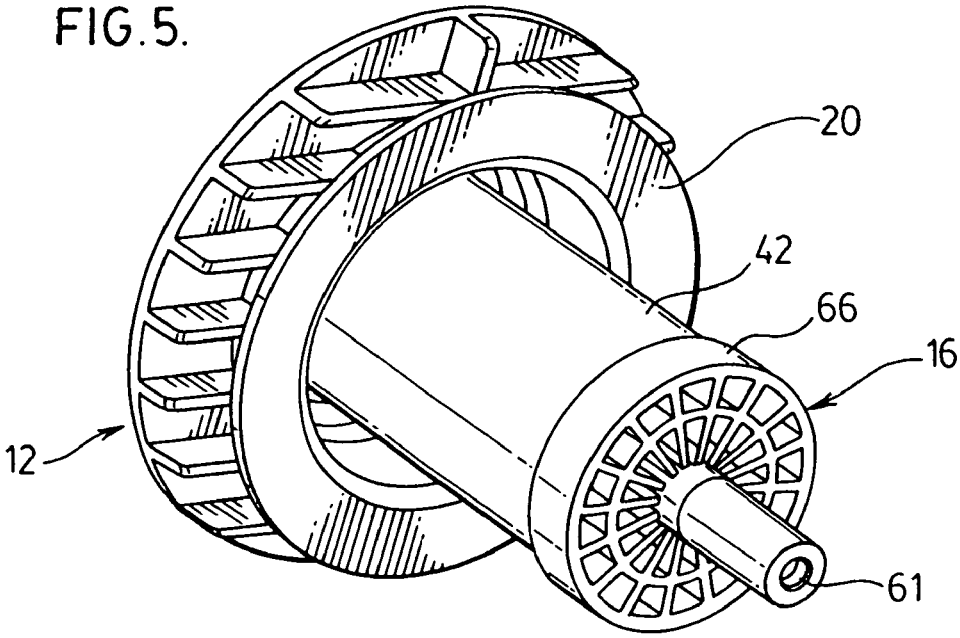
FIG. 5 is a pictorial view of the pump assembly of FIG. 2.
Figure 6:
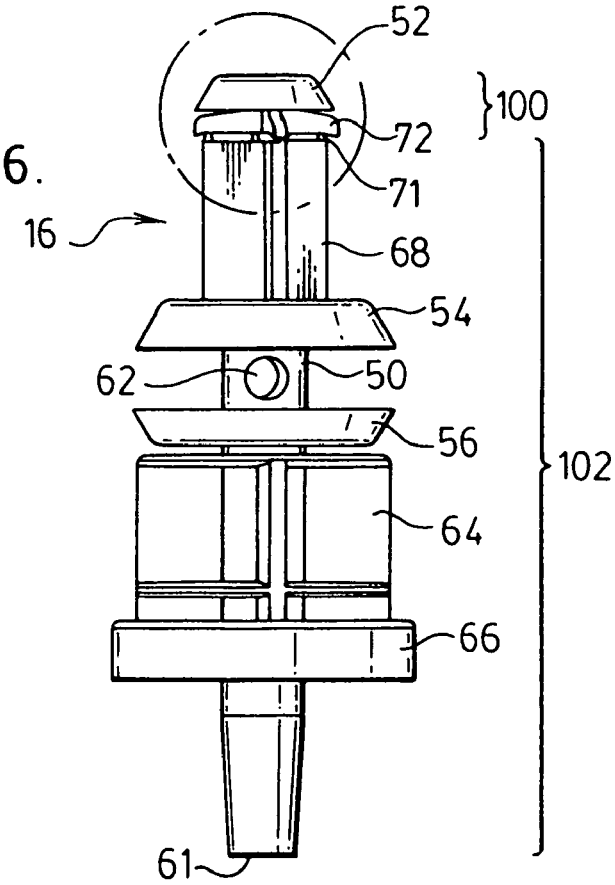
FIG. 6 is a side perspective view of the piston of FIG. 2.

Reference is made to FIG. 4 which illustrates a condition of the pump assembly 10 when the outer portion 102 of the piston 16 has been severed from the inner portion 100. The inner portion 100 is shown as including the piston catch member 72 and the first disc 52 which remain received within the inner chamber 30 and effective serve to restrict fluid flow inwardly therepast.

The outer portion 102 of the piston 16 is free to be removed outwardly out the open outer end 44 of the outer chamber 40. Reciprocal movement of the outer portion 102 of the piston 16 within the body 12 will not result in pumping of fluid from the container 26.

In operation of the preferred embodiment, in the normal stroke of operation, the piston 16 may be moved between a retracted position and an extended position. The extended position need not be a position as illustrated in FIG. 3 in which the piston catch member 72 engages the chamber catch flange 38. Preferably, in a full stroke of the piston 16 as controlled by the lever 88, the piston 16 will reach an extended position which is axially inwardly from the fully extended position and thus ensuring that in normal operation of the piston pump, by movement of the lever 88, the piston catch member 72 will not come to engage the annular catch flange 38.

In normal operation of the pump with movement of the piston 16 between a retracted position and an extended position, axially forces are applied to the outer portion 102 of the piston pump. In normal operation such forces include normal axially outwardly directed forces to move the piston from a retracted to an extended position in normal pumping which are less than an axially outwardly directed breaking force which, when applied to the piston 16, will rupture the strut members 71. To state this another way, the breaking force which is applied to the frangible strut members 71 is greater than the axially outwardly directed forces required to slide the piston 16 from the retracted to the extended position and movement of the pump 16 to normally operate the pump assembly 10.

The strut members 71 may have different forms. Preferably as shown, the strut members 71 extend normal to the axis 13 and each strut member is of a similar cross-sectional area and shape.

In the preferred embodiment, for assembly of the pump assembly 10, the piston catch members 72 are adapted to be moved inwardly into the inner chamber 30 past the annular catch flange 38. In this regard, the annular catch flange 38 of the first chamber 30 carries an outwardly directed surface which is tapered to extend axially inwardly and radially inwardly so as to provide a bevelled cam surface adapted to engage an upper camming surface on the inner side of the piston catch members 72. Engagement of the cam surfaces with the camming surfaces assists in deflecting the piston catch members 72 inwardly and/or the annular catch flange 38 outwardly such that the piston catch members 72 may pass upwardly into the inner chamber 30 in assembly. Similarly, the first disc 52 on the piston inner portion 100 are adapted to pass inwardly past the chamber catch flange 38.

Figure 9:
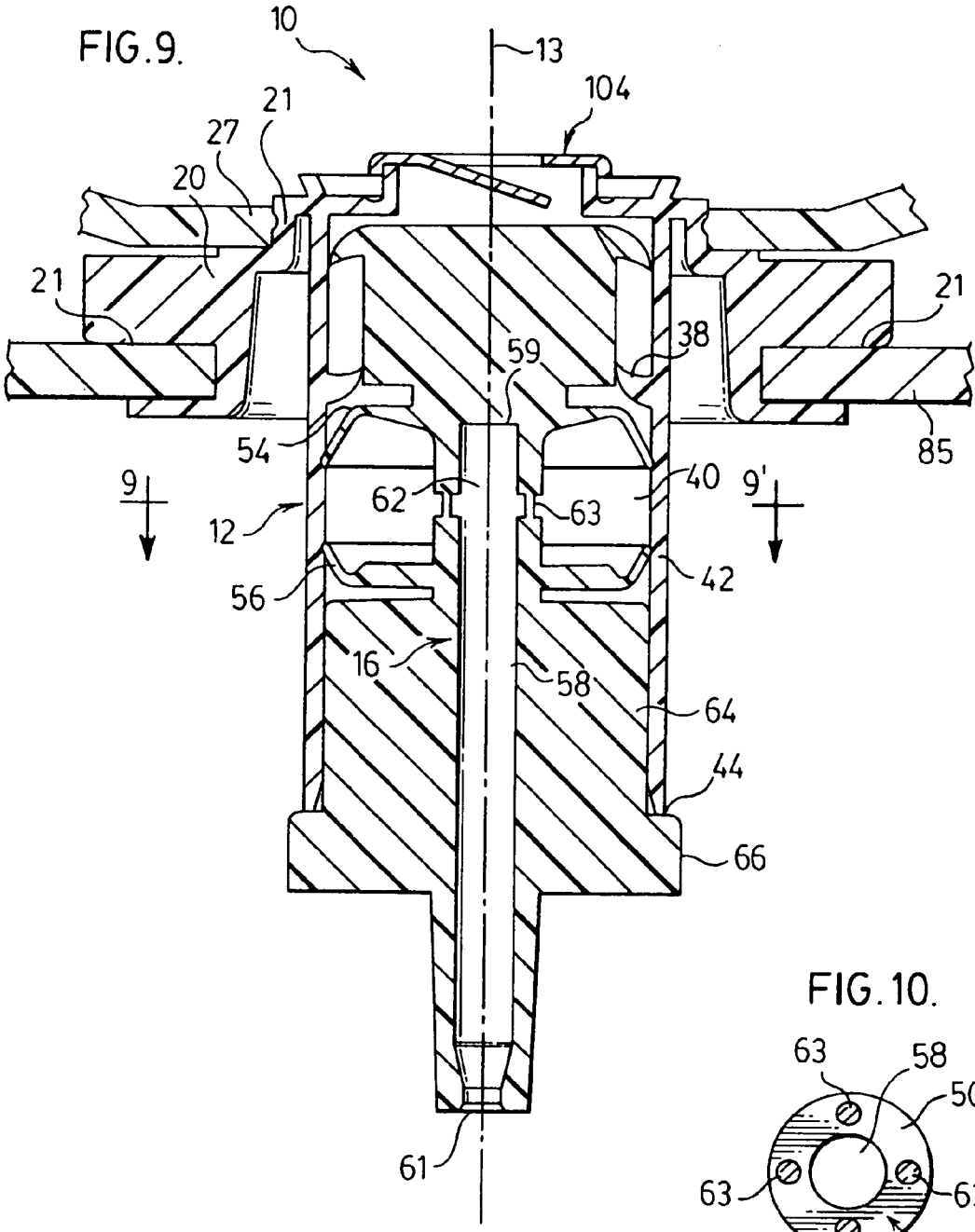
FIG. 9 is an enlarged cross-sectional side view of a pump mechanism similar to that shown in FIG. 2 but of a second embodiment of the present invention.
Figure 10:
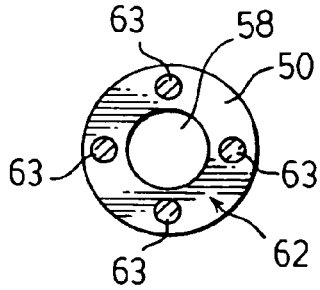
FIG. 10 is a cross-sectional side view along Section 9-9' in FIG. 9.

Reference is made to FIG. 9 which illustrates a second embodiment of a pump mechanism in accordance with the present invention. In FIG. 10, similar reference numerals are used to the reference numerals in the first embodiment to illustrate similar elements.

In FIG. 9, the body 12 is shown to be modified to eliminate the second chamber 30 and to provide an equivalent radially inwardly extending annular flange 38 on the wall 42 of the chamber 40. The piston 16, however, has been modified to eliminate the inner disc 52 of the first embodiment and, as well, portions of the stem 50 inward of the piston catch member 72. In replacement of the inner disc 52, a one-way valve 104 is provided across the inner end of the inner chamber 30. The piston catch members 72 are formed as a top portion of the webs 68 without frangible members therebetween. Rather, as best seen in cross-section in FIG. 10, the sidewall of the stem 50 intermediate the second disc 54 and the third disc 56 has been reduced so as to provide enlarged openings 62 bridged by a plurality of strut members 63 of reduced cross-section and therefore reduced strength such that they are frangible. In the embodiment of FIG. 9, the inner portion of the pump which is to remain after severing within the body 12 comprises that portion inward from the frangible strut members 63 and therefore includes the second disc 54 and the inner web 68 carrying the piston catch member 72. The outer portion which becomes severed includes the third disc 56, the web 64 and the engagement flange 66.

FIG. 1 illustrates the first embodiment of the invention used with a collapsible container 26, however, the first embodiment may be used with rigid containers as with various venting mechanisms whether through the container wall or through the pump mechanism. The frangible piston of the preferred embodiments may be used in a wide range of pumps having chambers in which the piston is slidable.

Figure 13:
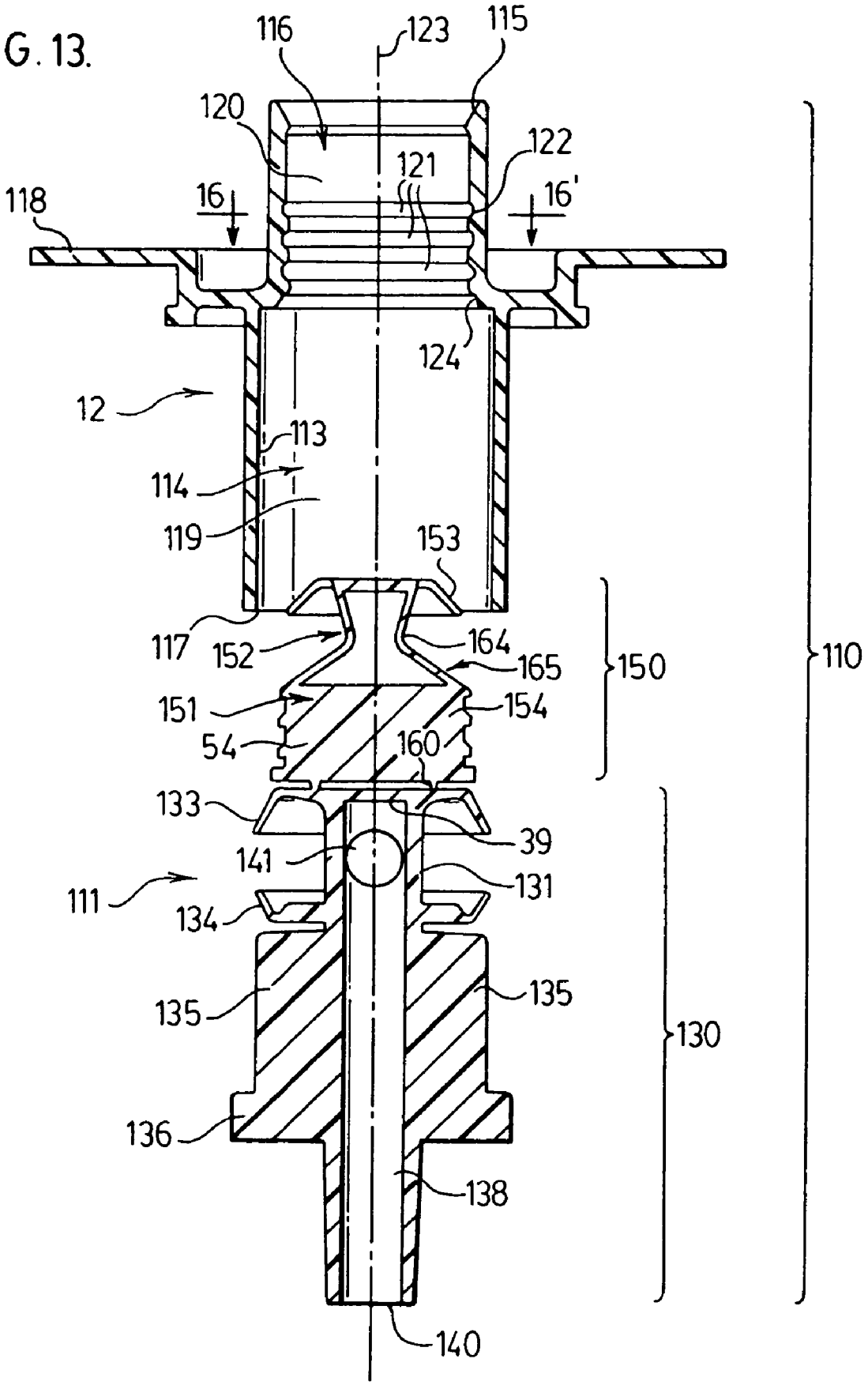
FIG. 13 is an exploded cross-sectional view showing firstly a cross-section of the piston forming element of FIG. 11 along section line 13-13' and a cross-section through a piston chamber-forming member.

Reference is made to FIGS. 11 to 16 which illustrates a pump 110 comprising, as best seen in FIG. 13, a piston chamber forming member 112 and a piston forming element 111.

The piston chamber forming member 112 is circular about a central axis 123 in cross-section normal the axis. The piston chamber forming member 112 has a chamber wall 113 which defines an internal chamber 114 therein comprising an outer chamber 119 and an inner chamber 120. The chamber 114 has an outer open end 117 and an inner end 115 with an inlet opening 116 through the inner end 115. A flange 118 extends radially outwardly from the chamber wall 113 and is adapted, for example, to assist in securing the piston chamber forming member 112 as to a reservoir to place the inlet opening 116 in communication with fluid from the reservoir.

The wall about inner chamber portion 120 carries in its radially inwardly directed surface three annular grooves 121, each providing catch surfaces 122 which, at least in part, are directed axially inwardly. An annular stop shoulder 124 is provided proximate the juncture between the outer chamber portion 119 and the inner chamber portion 120 and presents radially outwardly directed stop shoulder surfaces.

The piston forming element 111 comprises a piston 130 and a detachment portion 150 which are secured together by a plurality of frangible connection members 160.

The piston 130 includes a hollow stem 131 with a central passageway 138 open at an outer end at outlet 140 and closed at a blind inner end 139. A first piston disc 133 extends radially outwardly from the stem 131 proximate the inner end of the piston 130. A second piston disc 134 extends radially outwardly from the stem 131 spaced axially outwardly from the first piston disc 133. A plurality of radially and axially outwardly extending webs 135 are provided on the stem 131 to assist in coaxially locating the piston 130 within the outer chamber 119. A circular radially extending engagement flange 136 is provided at the outer end of the webs 135. The engagement flange 136 carries an axially inwardly directed stop surface of a diameter greater than the diameter of the chamber wall 113 for engagement of the chamber wall 113 at the outer open end 117 of the piston chamber forming member 112 to limit inward movement of the piston 130. Inlets 141 are provided through the tubular wall of the stem 131 located axially between the first piston disc 133 and the second piston disc 134 providing for communication into the central passageway 138.

The piston 130 is seen to be generally circular in cross-section about the axis 132 in cross-section normal to the axis.

The first piston disc 133 has an elastically deformable edge portion which extends radially outwardly coaxial of the axis 132 and is adapted to engage the cylindrical wall of the outer chamber 119 to prevent fluid flow past the first piston disc 133 in an inward direction and with the first piston disc 133 to elastically deform away from the cylindrical wall to permit fluid flow past the first piston disc 133 in an outward direction.

The second piston disc 134 extends radially outwardly coaxially about the axis 132 and has an elastically deformable edge portion to engage the cylindrical wall about the outer chamber 119 circumferentially thereabout to prevent fluid flow outwardly therepast.

The detachment portion 150 comprises a locating plug 151, a spring member 152 and a valve disc 153. The locating plug 151 is formed by four radially and axially extending plug locating webs 154 joined at a common center about the axis 132. Each of the plug locating webs 154 has an outwardly directed outer end 155. Four frangible connection members 160 are provided. Each connection member 160 is a short axially extending cylindrical rod secured at one end to an outer end 155 of one of the plug locating webs 154 and, at the other end, to an axially inwardly directed end wall of the first piston disc 133.

Each plug locating web 154 has a radially outwardly directed side end 156 for engagement with the wall of the inner chamber 120. Each side wall 156 carries radially outwardly extending detachment catch members 158 presenting axially outwardly directed detachment catch shoulders 159 and camming surfaces 157. Each side end 156 also carries proximate its axially outer end, a detachment stop member 161 presenting an axially inwardly directed detachment stop surface 162.

Each plug locating web 154 has an inner end 163.

The valve disc 153 comprises a circular flexing disc extending radially outwardly coaxially about the axis 132 and having an elastically deformable edge portion to engage the wall portion of the inner chamber 120 circumferentially thereabout to prevent fluid flow past the valve disc 153 in an inward direction and with the valve disc 153 elastically deforming away from the wall to permit fluid flow past the valve disc 153 in an outward direction.

The spring member 152 connects the valve disc 153 to the locating plug 151. The spring member 152 comprises two diametrically opposed arms 165, each of which are secured at an outer end 166 to the locating plug 151 at diametrically opposite radially outermost portions of the inner end 163 of two plug locating webs 154. The spring arms 165 are secured at an inner end 167 to an outer side of the valve disc 153 radially inwardly from its flexing edge portion 168. Each of the arms 165 are seen in side view in FIGS. 11 and 13 to be elongate from their outer end 166 to their inner end 167, having a relatively small rectangular cross-section, and to be V-shaped as seen in side view in FIGS. 11 and 13. The spring arms 165 are capable of being deflected as to move an apex 164 of each spring arm closer to the axis 132 as can be of assistance as in permitting the valve disc 153 to tilt to a position in which it is not disposed coaxial to the axis 132.

The piston chamber forming member 112 is preferably formed as an integral element from plastic as by injection moulding.

The piston forming element 111, including the piston 130, the frangible connection members 160 and the detachment portion 150, is also preferably formed as an integral member from plastic as by injection moulding.

Assembly and use of the piston forming element 111 and the piston chamber forming member 112 is now discussed.

Figure 16:
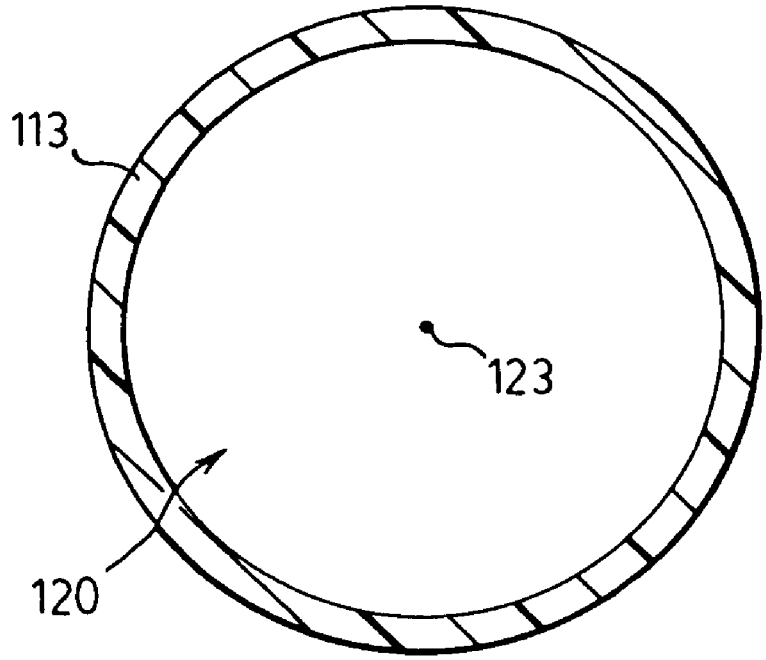
FIG. 16 is a cross-sectional view through section line 16-16' in FIG. 13.

FIG. 13 illustrates the piston forming element 111 aligned for initial insertion into the piston chamber forming member 112. From the position shown in FIG. 13, the piston forming element 111 is slid coaxially into the piston chamber forming member 112 to a fully inserted position as illustrated in FIG. 14. In the fully illustrated position as seen in FIG. 14, the detachment portion 150 is received against removal in the inner chamber 120. In this regard, the locating plug 151 becomes secured in a snap fit within the inner portion 120 by reason of the detachment catch members 158 becoming engaged with the grooves 121 and, more particularly, with the axially inwardly directed catch surfaces 122 engaging axially outwardly directed detachment catch shoulders 159. Inward movement of the detachment portion 150 into the inner chamber 120 is limited by the detachment stop members 161 and their detachment stop surfaces 162 engaging the chamber stop shoulders 124. With the detachment portion 150 secured in snap fit in the inner chamber 120 as seen in FIGS. 14, 15 and 16, the detachment portion 150 is considered to be in an operative position for functioning of the pump. In this operative position, the valve disc 153 cooperates with the inner chamber 120 to provide a first inner one-way valve mechanism permitting fluid flow through the inner end 115 of the chamber 114 from the fluid reservoir into the chamber 114 yet preventing fluid flow outwardly through the inner end 115 of the inner chamber 120 past the valve disc 153.

After insertion of the piston forming element 111 into the piston chamber forming member 112 to place the detachment portion 150 in the operative position, axially outwardly directed forces are applied to the engagement flange 136 of the piston 130 to draw the piston 130 outwardly. Such axially outwardly directed forces are transferred from the piston 130 through the frangible connection members 160 to the detachment portion 150. The axial forces which the frangible connection members 160 may cumulatively bear is selected to be less than axially outwardly directed forces required to disengage the locating plug 151 from its securement within the inner chamber 120. As a result, with the application of such forces, the frangible connection members 160 are broken thus severing the piston 130 from the detachment portion 150 such that the piston 130 is free to coaxially slide inwardly and outwardly within the outer chamber 119 as, for example, illustrated in FIG. 15. Severing of the frangible connection members 160 is preferably accomplished merely by applying axially directed forces to the piston 130. However, severing may also be accomplished merely by applying rotational forces to the piston 130 if the detachment portion is frictionally engaged in the piston chamber forming member 112 against rotation about axis 123 except under rotational forces greater than that required to sever the connection members 160. Of course, a combination of axially directed and rotational forces could be used. Preferably, the insertion of the piston forming element 111 and application of forces thereto to sever the connection members 160 may be merely axial forces since, in many applications, merely axial forces are generated in initial and subsequent operation of dispensing mechanisms to dispense fluid.

After initial separating of the piston 130 from the detachment portion 150, the piston 130 is then free for coaxial reciprocal movement inwardly and outwardly in the chamber as in a cycle having an instroke and an outstroke. In such reciprocal movement of the piston 130, the first piston disc 133 serves as a second, outer one-way valve in the chamber 114 inward of the second piston disc 134 permitting fluid flow outwardly past the first piston disc 133 to between the first piston disc 133 and the second piston disc 134 and, hence, through the inlets 141 to the central passageway 138 and via the central passageway 138 to exit the outlet 140. The second piston disc 134 acts as a piston head which engages the cylindrical chamber wall 113 in the outer chamber 119 to, in an instroke, create pressure in the chamber 114 between the inner one-way valve formed by the valve disc 153 and the outer one-way valve formed by the first piston disc 133 with such pressure closing the inner one-way valve by urging the valve disc 153 into a closed position against the wall of the inner chamber 120 and dispensing fluid out of the outer one-way valve, that is, past the deflecting first piston disc 133 and, hence, out the central passageway 138 to the outlet 140. In an outstroke, the first piston disc 133 acts as a piston head to effectively create a vacuum or suction in the chamber 114 inwardly of the first piston disc 133 causing closing of the outer one-way valve being the first piston disc 133 and drawing fluid into the chamber 114 through the inlet opening 116 through the inner one-way valve by reason of deflection of the valve disc 153. Fluid flow is permitted axially through the detachment portion 150 through axially extending passageways between adjacent plug locating webs 154.

Reference is made to FIG. 16 which illustrates a cross-sectional view through the piston chamber forming member 112 along section line 16-16' in FIG. 13 which shows the inner chamber 120 as having a generally continuous cylindrical inner wall.

Figure 17:
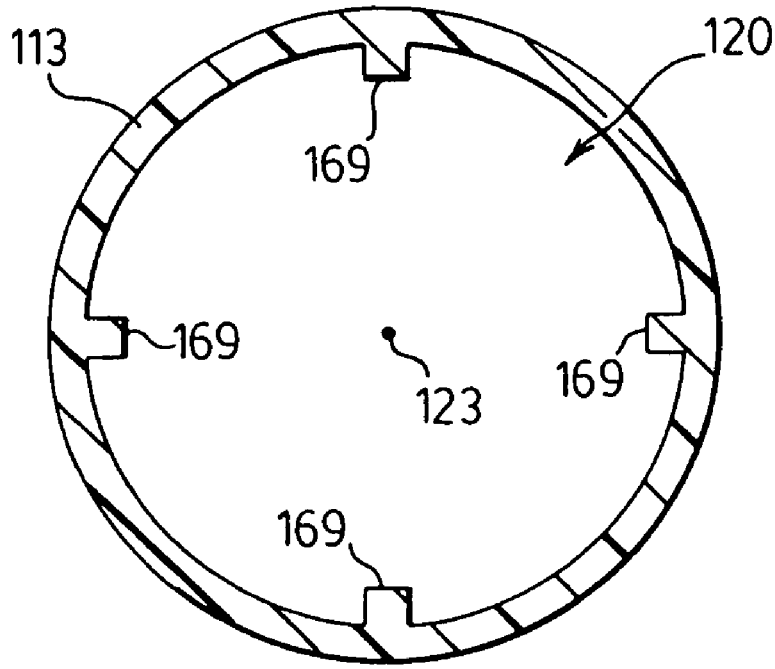
FIG. 17 is a cross-sectional view the same as FIG. 16 but of a fourth embodiment of the piston chamber forming member.

Reference is made to FIG. 17 which shows a cross-section identical to that shown in FIG. 16, however, of an alternate embodiment of the piston chamber forming member 112 which is identical to the embodiment of FIGS. 13 to 16 with the exception of the addition of four radially inwardly at least partially axially extending stop ribs 169 that are provided inside the inner chamber 120 to mechanically limit rotation of the detachment portion 150 relative to the piston chamber forming member 112. Such stop ribs 169, after initial insertion, do not interfere with the flexing and/or tilting of the valve disc 153. The stop ribs 169 are provided to engage side surfaces 170 or 171 of the plug locating webs 154 to restrict the locating plug 151 from rotation about the axis 123 within the inner chamber 120 past a position in which a plug locating web 54 engages a stop rib 69 upon rotation of the piston forming element 130 via its engagement flange 136. Thus, after initial insertion of the piston forming element 111 to locate the detachment portion 150 in the operative position secured in the inner chamber 120, the piston forming element can be rotated by rotation of the engagement flange 136 thus tending to rotate not only the piston 130 but also the detachment portion 150 by transfer of the rotational forces through the frangible connection members 160. If the friction against relative rotation of the detachment portion 150 in the inner chamber is, in itself, not sufficient to break the frangible connection member 160, on the plug locating webs 154 engaging the stop ribs 169 and preventing further rotation of the detachment portion 150, additional rotational forces can be applied to the piston 130 which are sufficient to rupture the flexible connection member 160.

The stop ribs 169 in the inner chamber 120 may preferably be provided with axially outwardly directed cam surfaces which, in the event in initial insertion the plug locating webs 154 are axially aligned with the stop ribs 169 and engage the stop ribs 169, the cam surfaces will on inward movement of the detachment portion 150 urge the locating plug 151 to rotate about the axis 123 to avoid interference and permit the detachment portion 150 to be slid axially into the operative position.

Figure 18:
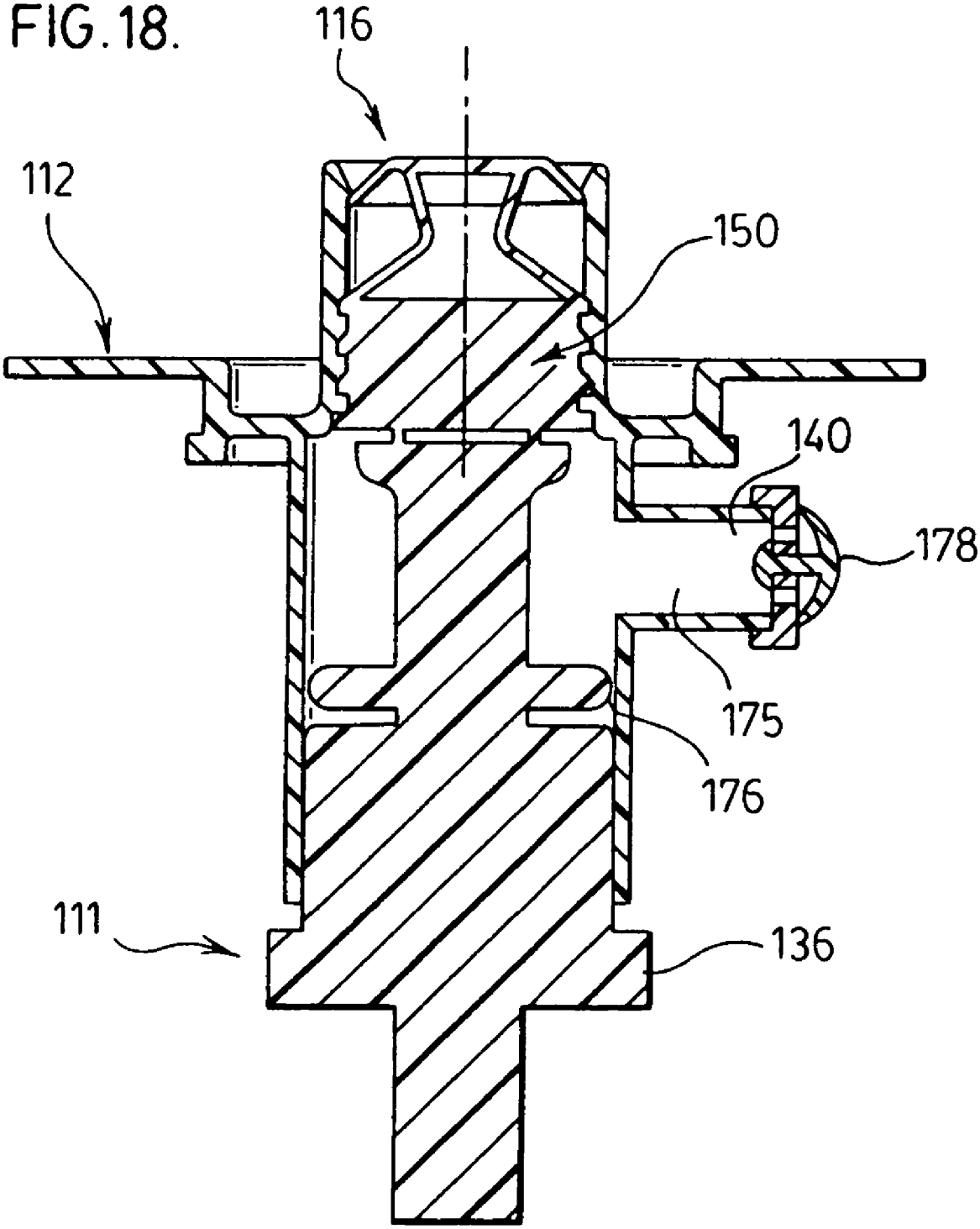
FIG. 18 is a view the same as FIG. 4 but showing a fifth embodiment of a pump with an outlet through a side wall of the chamber.

Reference is made to FIG. 18 which shows an embodiment similar to that in FIG. 14, however, in which the outlet 140 is via an outlet opening 175 in the side wall 113 of the outer chamber 119, the piston 130 merely carries a single piston disc 176 which prevents fluid flow therepast in either direction, and a separate outer one-way outlet valve 178 is provided across the outlet opening 75 from the side of the chamber permitting fluid flow outwardly but preventing fluid flow inwardly therethrough. In this embodiment, dispensing is via the outlet 140 in the side of the chamber 114 rather than an outlet 140 centrally from the outer end of the piston 130 as in FIG. 14.

Figure 11:
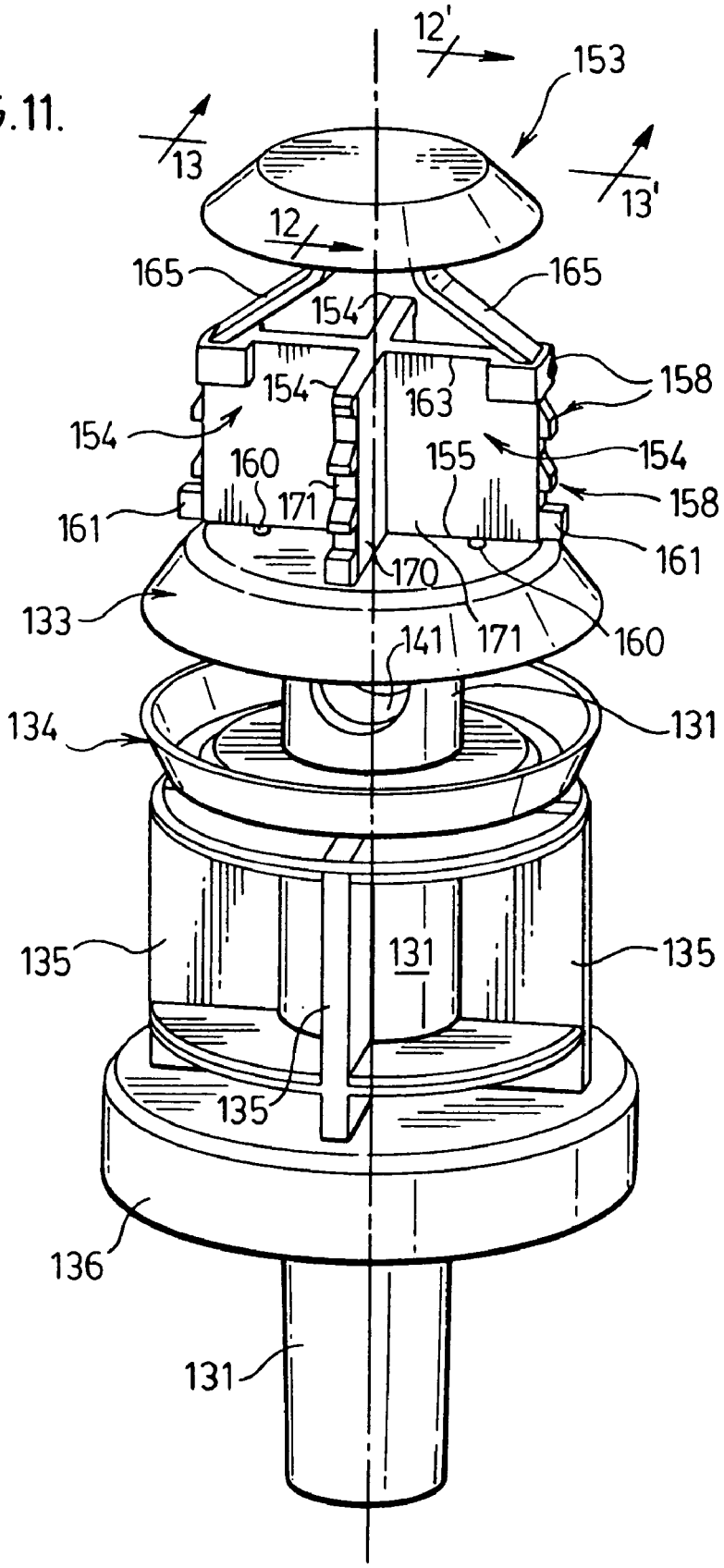
FIG. 11 is a perspective view of a piston forming element in accordance with a third embodiment of the present invention.
Figure 12:
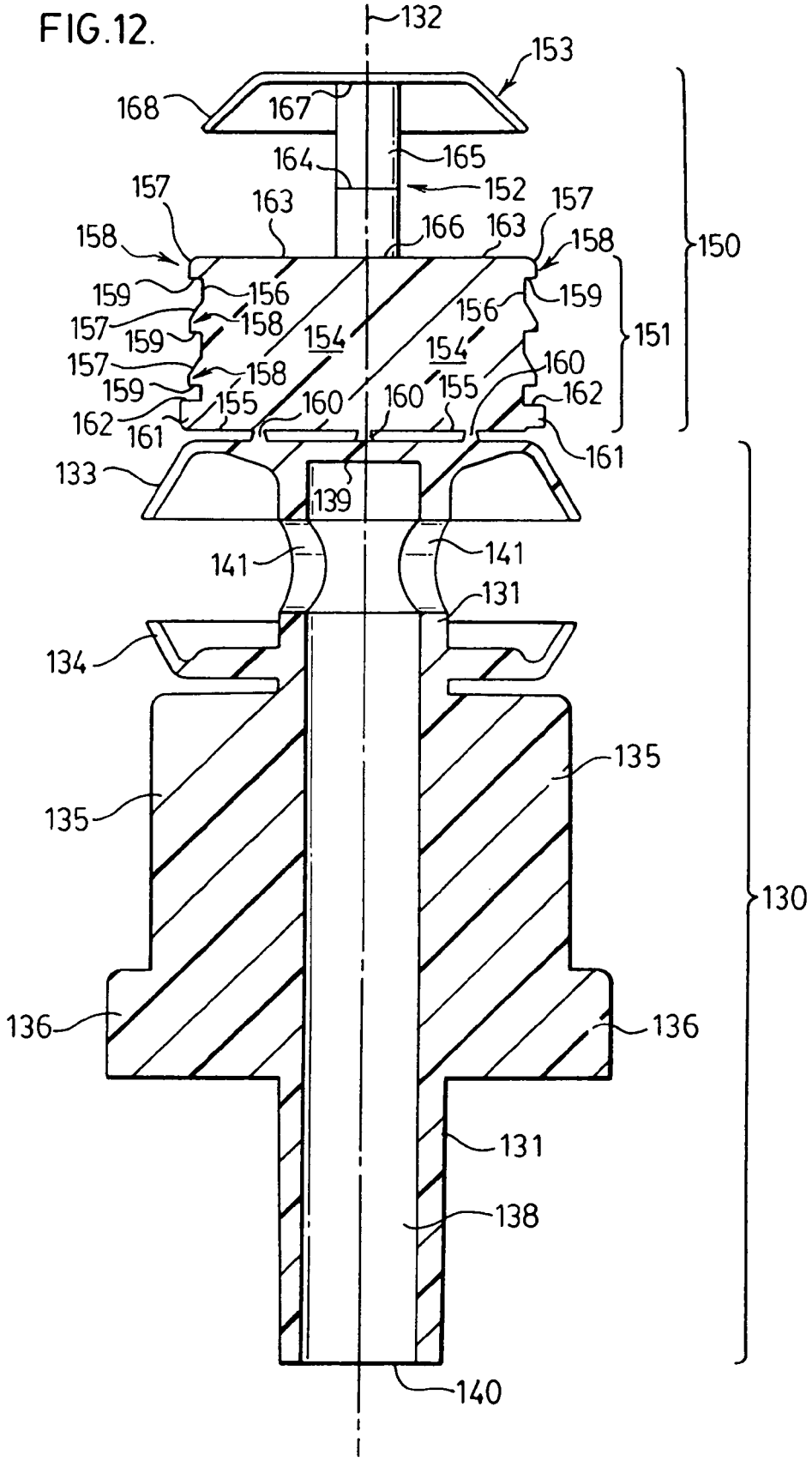
FIG. 12 is a cross-sectional side view of the piston forming element of FIG. 11 along section line 12-12'.
Figure 19:
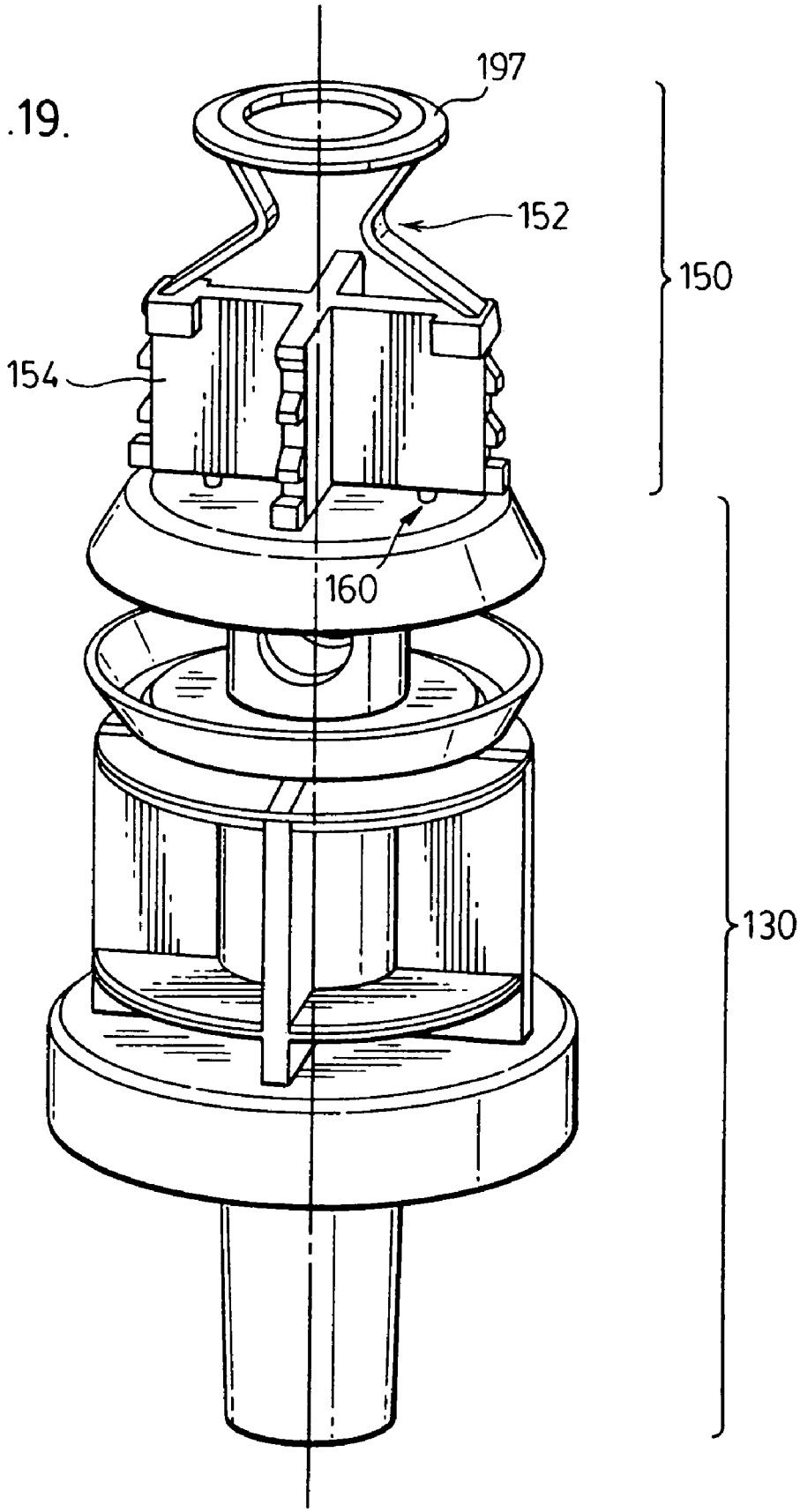
FIGS. 19 and 20 are views the same as FIGS. 11 and 13 but of a sixth embodiment providing an inner one-way ball valve.
Figure 20:
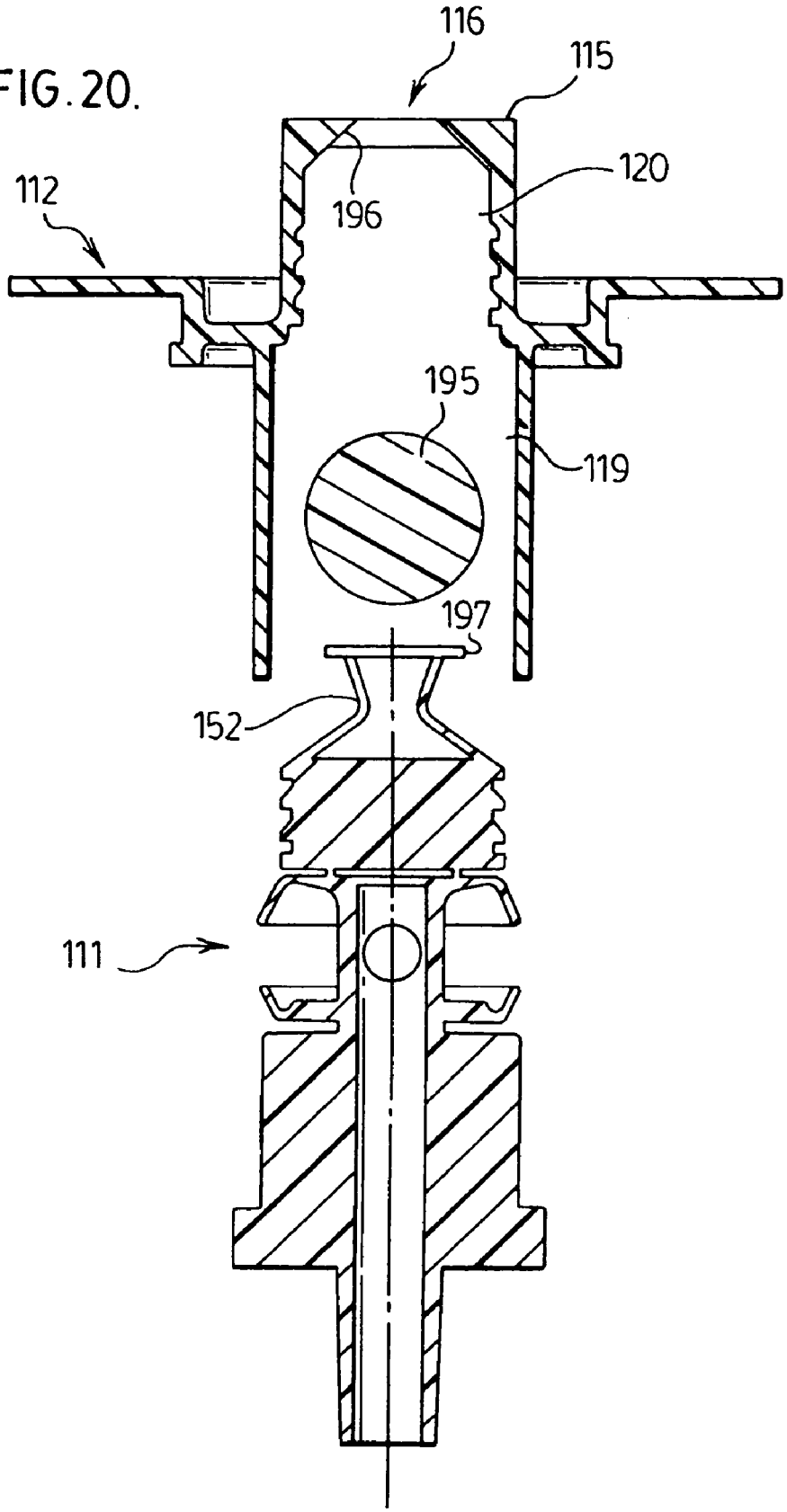

Reference is made to FIGS. 19 and 20 which illustrate an embodiment substantially identical to the embodiment shown in FIGS. 11 and 13, however, in which a spherical ball 195 is provided as a separate element, the inner end 115 has an annular valve seat 196 provided about its inlet opening 116 which the ball 195 may engage to form a seal against fluid flow inwardly therepast, and the detachment portion 150 is modified to replace the valve disc 153 by an annular ring 197 which does not engage the wall of the inner chamber 120 but rather engages in its center the ball 195 and urges it inwardly by the spring 152. The annular ring 197 and spring 152 which urge the ball 195 towards the valve seat 196 may be eliminated where the pump assembly is to be used inverted from the position shown in FIGS. 19 and 20 and the ball 195 will, under gravity, rest on the annular valve seat 196.

Figure 21:
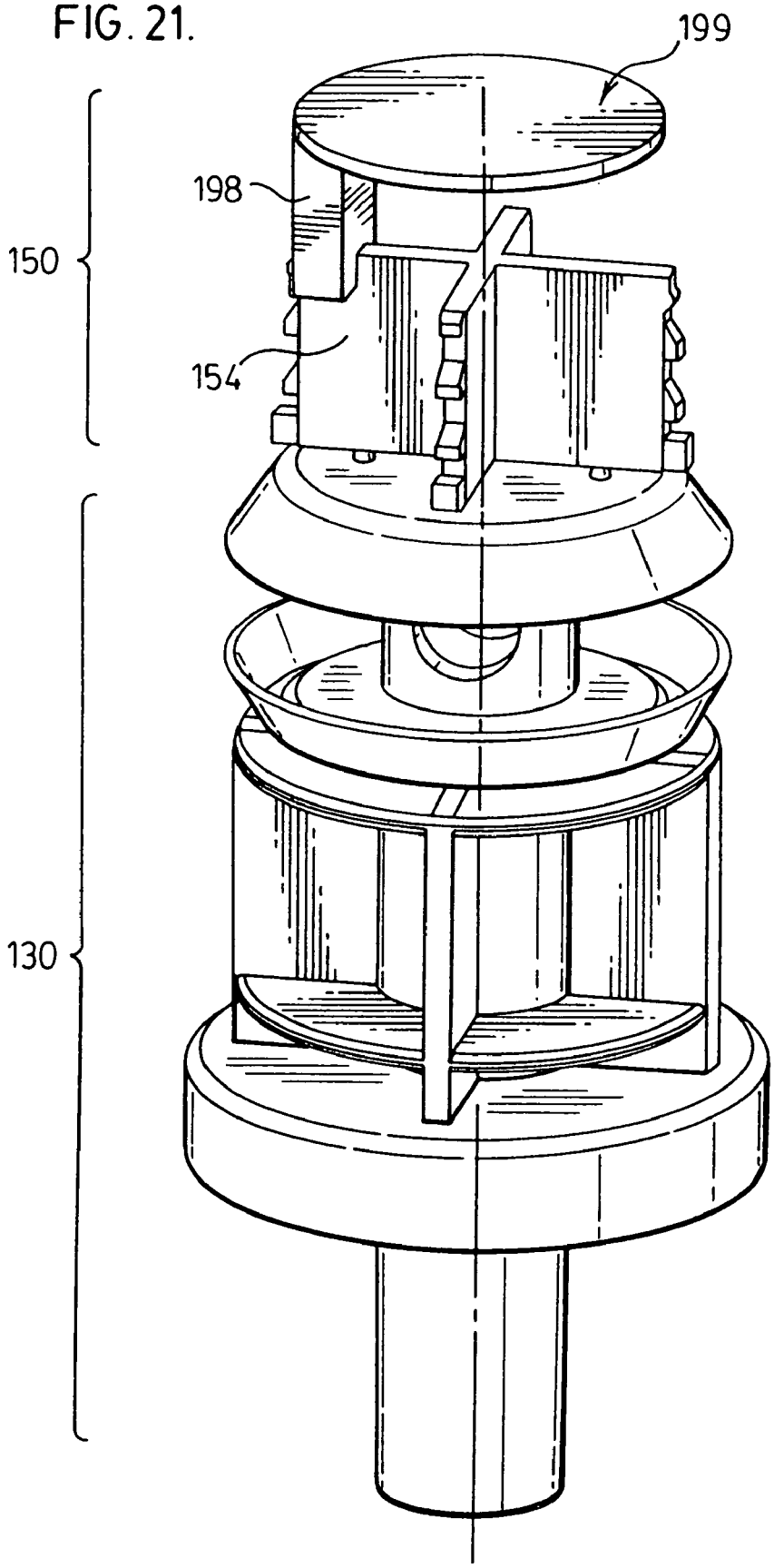

Reference is made to FIGS. 21 and 22 which illustrate an embodiment similar to that in FIGS. 11 and 14, however, in which the detachment portion 150 carries on plug locating web 154 an axially inwardly extending arm 198 which supports a deflectable flap 199. When the detachment portion 150 is secured in the operative position as seen in FIG. 22, the flap 199 sits on an annular valve seat 200 carried by the piston chamber forming member 112 and presenting the inlet opening 116 to be of a smaller diameter than the flap 199. The flap 199 sits on the seat 200 to prevent fluid flow inwardly and is deflectable outwardly as seen in dashed lines for fluid flow outwardly.

Figure 24:
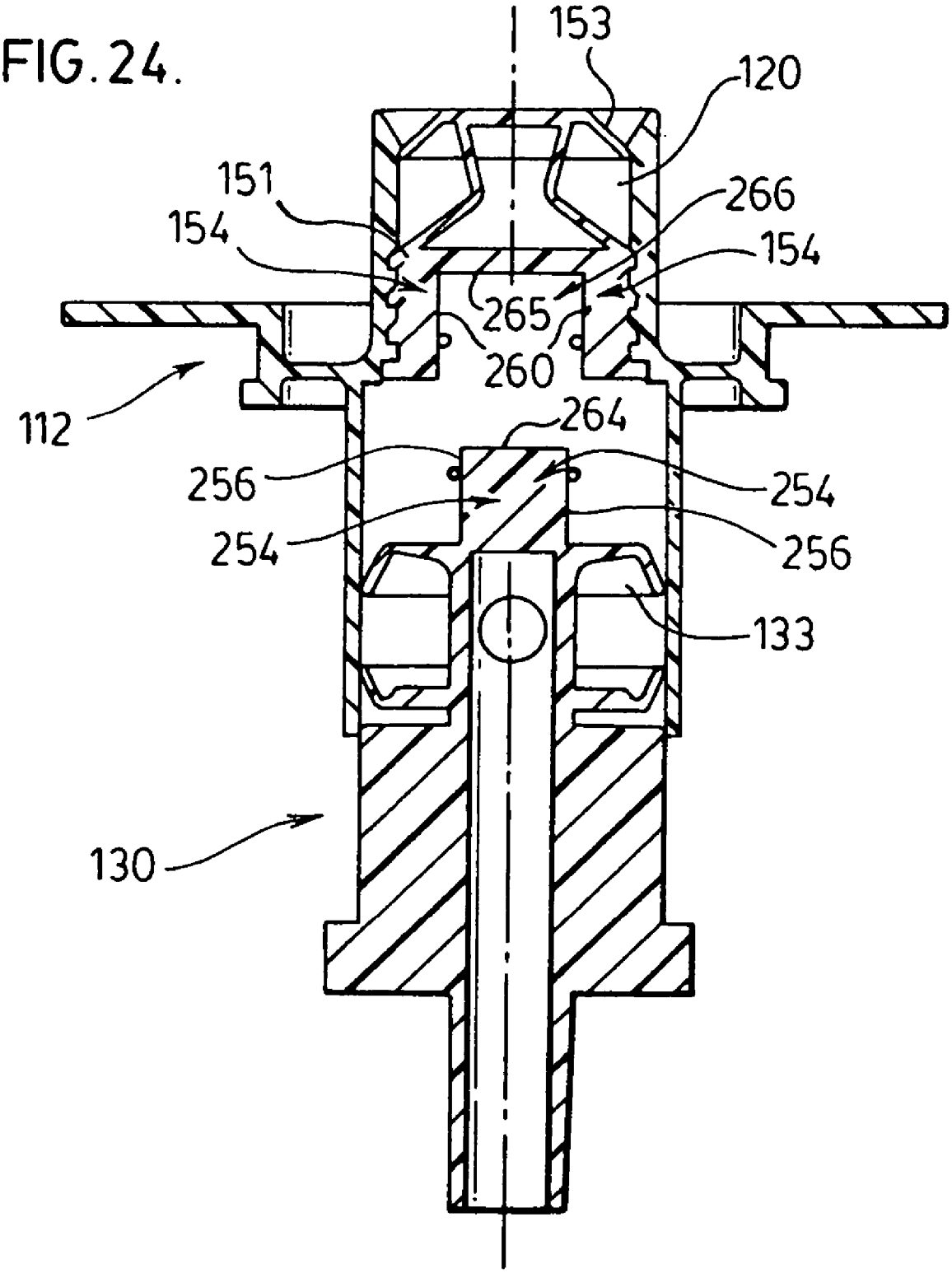
FIG. 24 is a cross-sectional side view similar to that in FIG. 23 but showing the piston forming element as separated with its attachment portion secured in the piston chamber forming member in an operative position and the piston moved outwardly in an outstroke.

Reference is made to FIGS. 23 and 24 which illustrate an embodiment substantially the same as that illustrated in FIGS. 11 to 15, however, varying in respect of the nature of the frangible connection members 160. In the embodiment of FIGS. 23 and 24, the locating plug 151 has a central portion of each of its four plug locating webs 154 removed and radially inner locating webs 254 are securely coupled to the end wall of the first piston disc 133. The radially inner locating webs 254 have radially outwardly directed surfaces 256 which are spaced from radially inwardly directed surfaces 260 on the radially outer locating webs 154. Four frangible connection members 160 are provided each connecting a respective outer locating web 154 with an inner locating web 254 and extending between the radially outwardly directed surface 256 of the inner webs 254 and the radially inwardly directed edge of the outer locating webs 154. The inner locating webs 254 extend axially inwardly to an inner end 264 which is spaced axially from an axially inner end 265 of the outer locating webs 154 so as to provide an axial space 266 therebetween. In accordance with this invention, the connection members 160 may preferably be broken by moving the piston 130 inwardly relative to the locating plug 151 after the locating plug 151 has become fixed in the inner chamber portion 120 against further movement inwardly permitting the frangible connection members 160 to be broken by movement of the piston 10 axially inwardly relative to the detachment portion as can be advantageous, for example, in dispensers in which a manually activated lever receives manual pressure to move the piston 130 axially inwardly as contrasted having mere spring pressure which, in some other dispensers, may be utilized to move the piston 130 axially inwardly. While the embodiment of FIGS. 23 and 24 is more preferably adapted for breaking of the frangible connection member 160, on moving the piston 130 axially inwardly, it is to be appreciated that the connection members 160 could also be broken by moving the piston 130 axially outwardly. However, to break the connection members 160 on moving axially outwardly, the frangible connection members 160 must break under forces less than the forces by which the locating plug 151 is retained within the inner chamber portion 120.

Reference is made to FIGS. 25 to 28 illustrating a further embodiment in accordance with the present invention and in which breaking of frangible connection members 160 connecting the detachment portion 150 and the piston 130 is preferably accomplished by axial inward movement of the piston 130 while the locating plug 151 is fixedly secured in the inner chamber portion 120. As seen in FIGS. 23 to 28, the end wall of the first piston disc 133 carries two rearwardly extending radially inner webs 254 each of which is coupled to one of two diametrically opposed outer locating webs 154 at a relatively thin intersection of a radially outwardly axially inwardly edge of the inner locating disc 254 with a radially inwardly directed surface of the outer locating webs 154. Thus, as shown in FIGS. 25 to 28, this connection forms effectively two frangible connection members 160. By axial inward movement of the piston 130 relative to the locating plug 151 while the locating plug 151 is fixed in an inner chamber portion, these two frangible connection members 160 are severed and the two inner locating webs 254 slide inwardly into the recesses 266 in the locating webs 154. The axial inner end 264 of each inner web 254 is adapted for engagement with the axial inner end 265 of the locating webs 154 to ensure that the locating plug 151 may be urged fully into the inner chamber portion 120 and fully seats therein.

At the center of two of the locating webs 154, a central finger member 268 extends axially outwardly. A U-shaped tethering strap 270 is provided having a bight 272 and two arms 273 and 274 with the outer arm 273 connected at its end to the end wall of the first piston disc 133 proximate the center of the disc 133 and the inner arm 274 connected to the central finger 268 on the locating plug 151 between the two inner locating webs 254. The tethering strap 270 is a foldable hinge-like member serving to secure the piston 130 to the detachment portion 150 after severing of the frangible connection members 160 and to prevent undesired withdrawal of the piston 130 fully outwardly from the outer chamber portion. The tethering strap 270 thus provides a function of not interfering with the severing of the frangible connection members 160 yet preventing the piston 130 from inadvertently being withdrawn and removed from the outer chamber portion.

Figure 28:
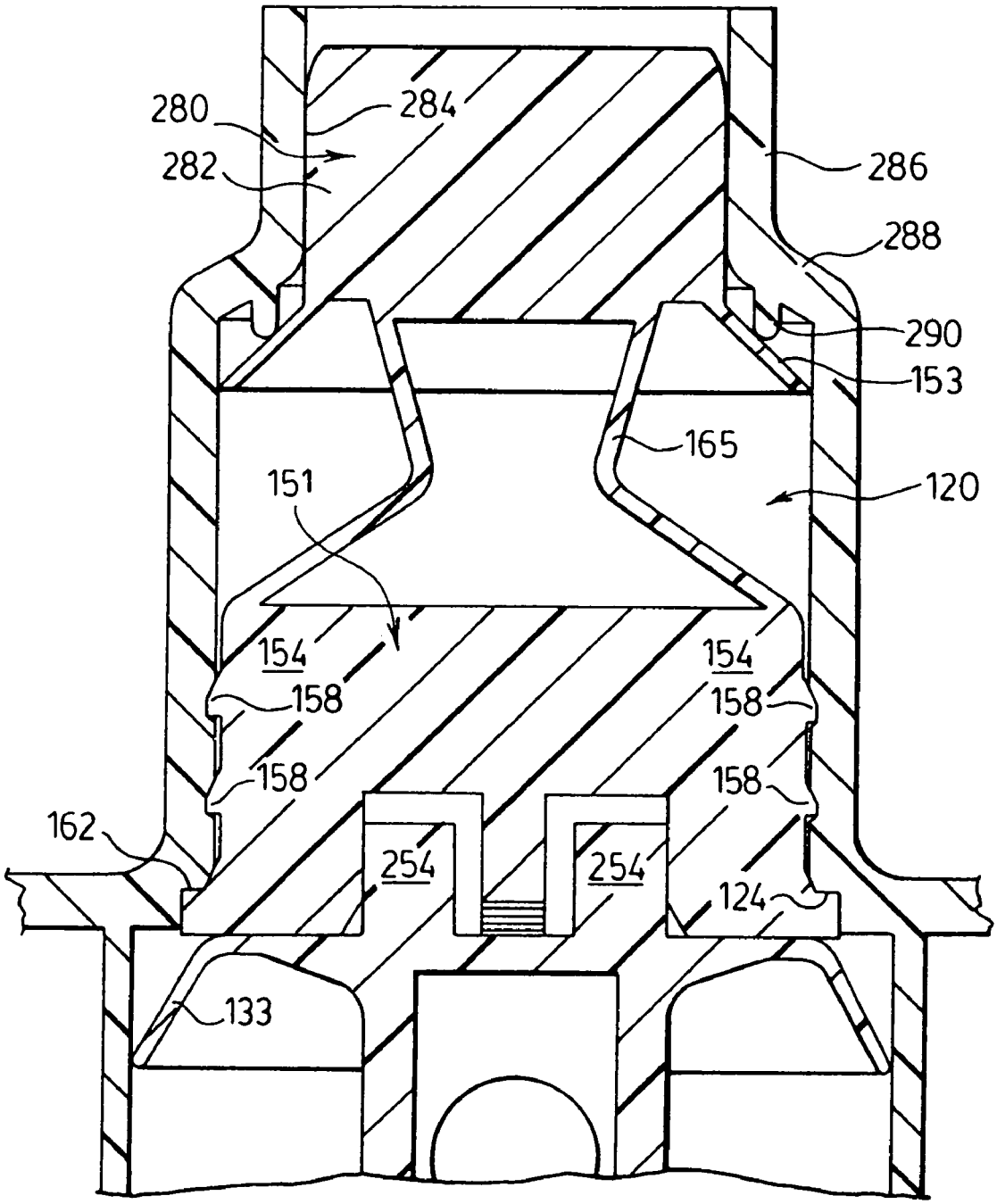
FIG. 28 is an enlarged cross-sectional view of the inner end of the piston forming element shown in FIG. 26 as received inside the inner end of a piston chamber forming member.

In the embodiment of FIGS. 25 to 28, the valve disc 153 carries on its inner end a locating member 280 having a plurality of radially and axially extending locating webs 282 each with radially outwardly directed surfaces 284 for sliding engagement within a cylindrical innermost chamber portion 286 provided as an axially inward extension of the inner chamber portion 120 as seen only in FIG. 28 as to provide for maintaining the valve disc 153 coaxially disposed within the inner chamber portion 120. FIG. 28 also shows that on a transitional shoulder 288 between the lesser diameter innermost chamber portion 286 and the larger diameter chamber portion 120, an axially outwardly extending annular flange 290 is provided for enhanced engagement by a radially outwardly and axially inwardly directed periphery of the valve disc 153.

Figure 29:
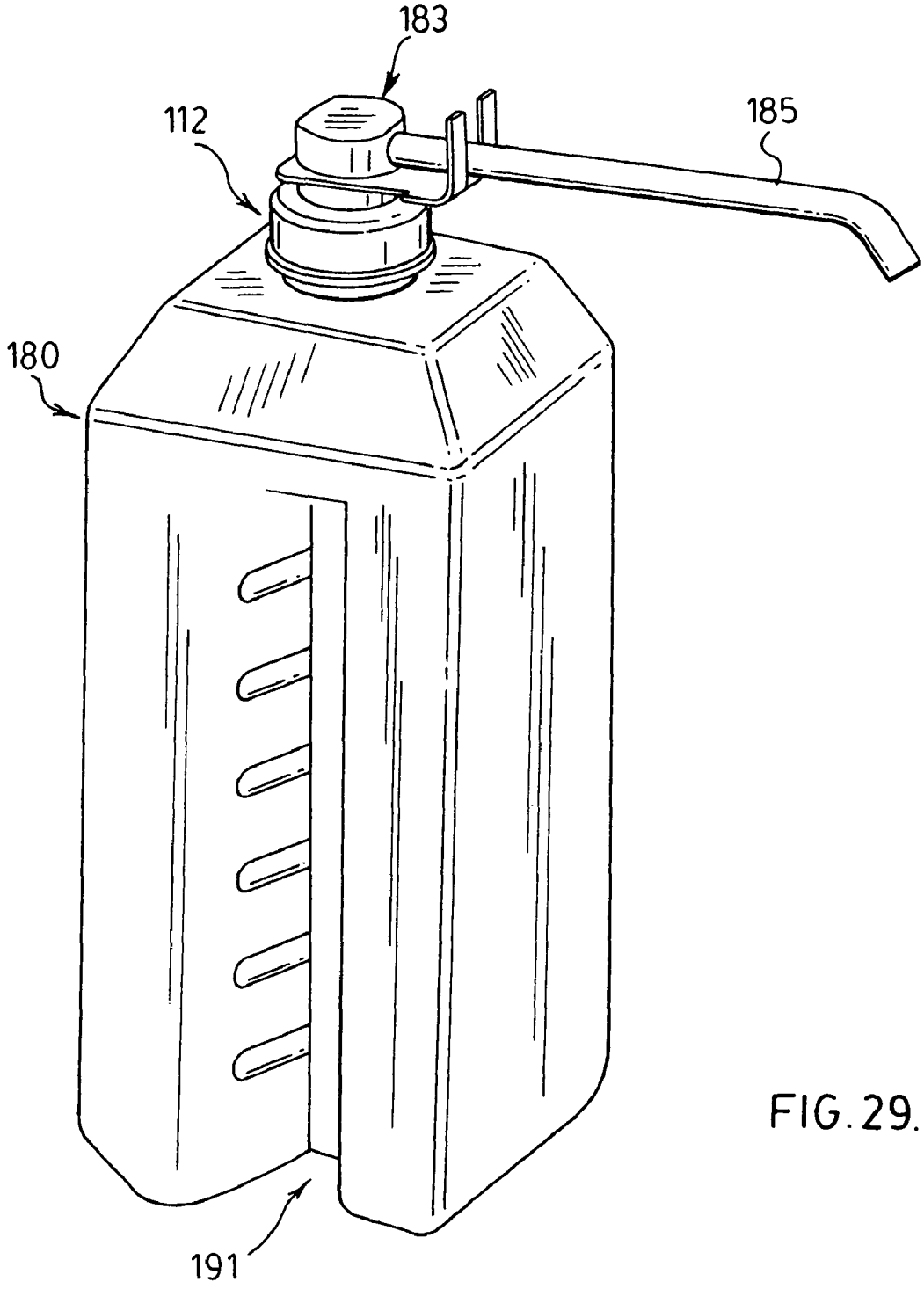
FIG. 29 is a pictorial view of an assembled fluid dispenser in accordance with a tenth embodiment of the invention.
Figure 30:
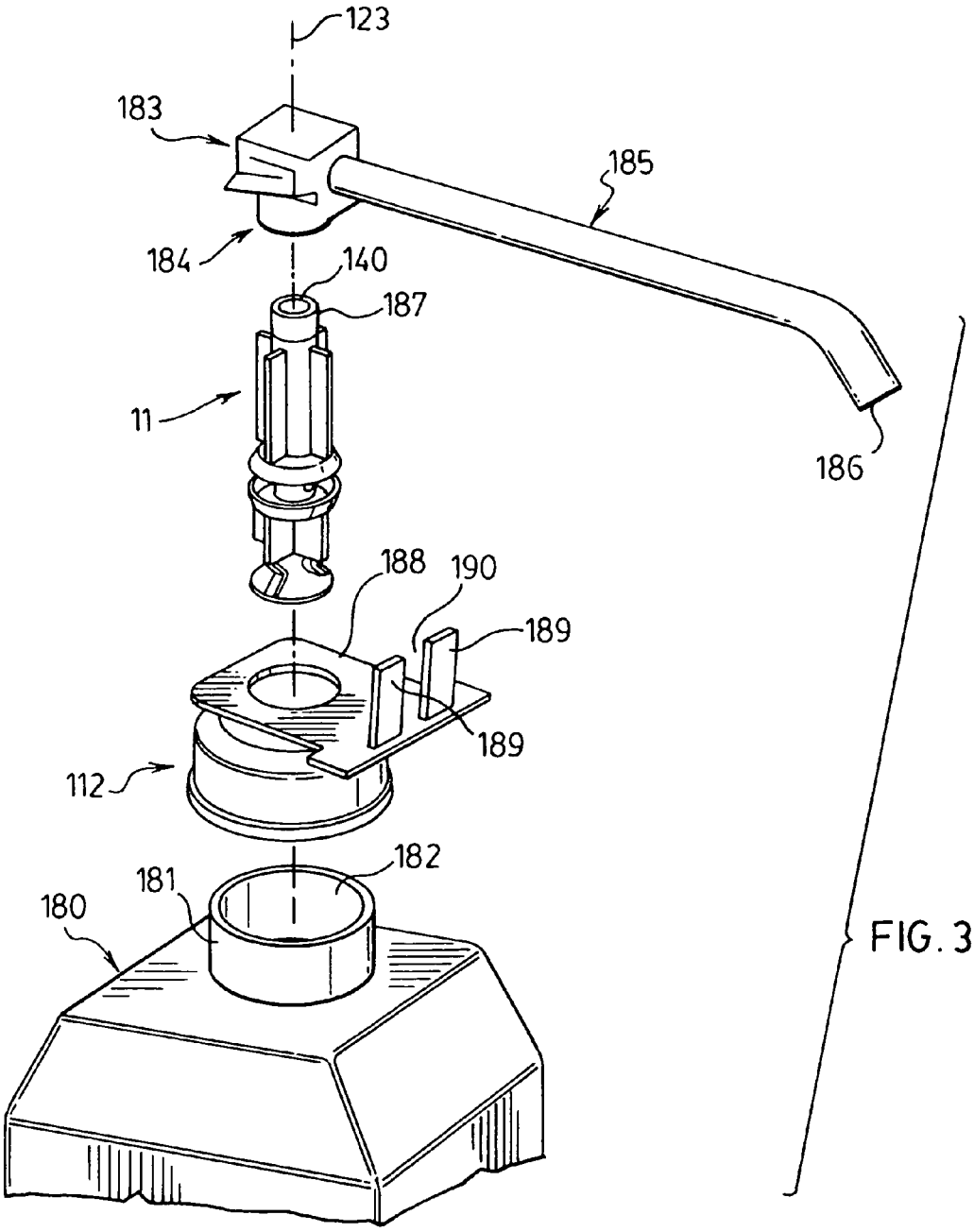
FIG. 30 is an exploded pictorial view of the pump assembly of the dispenser of FIG. 29.
Figure 31:
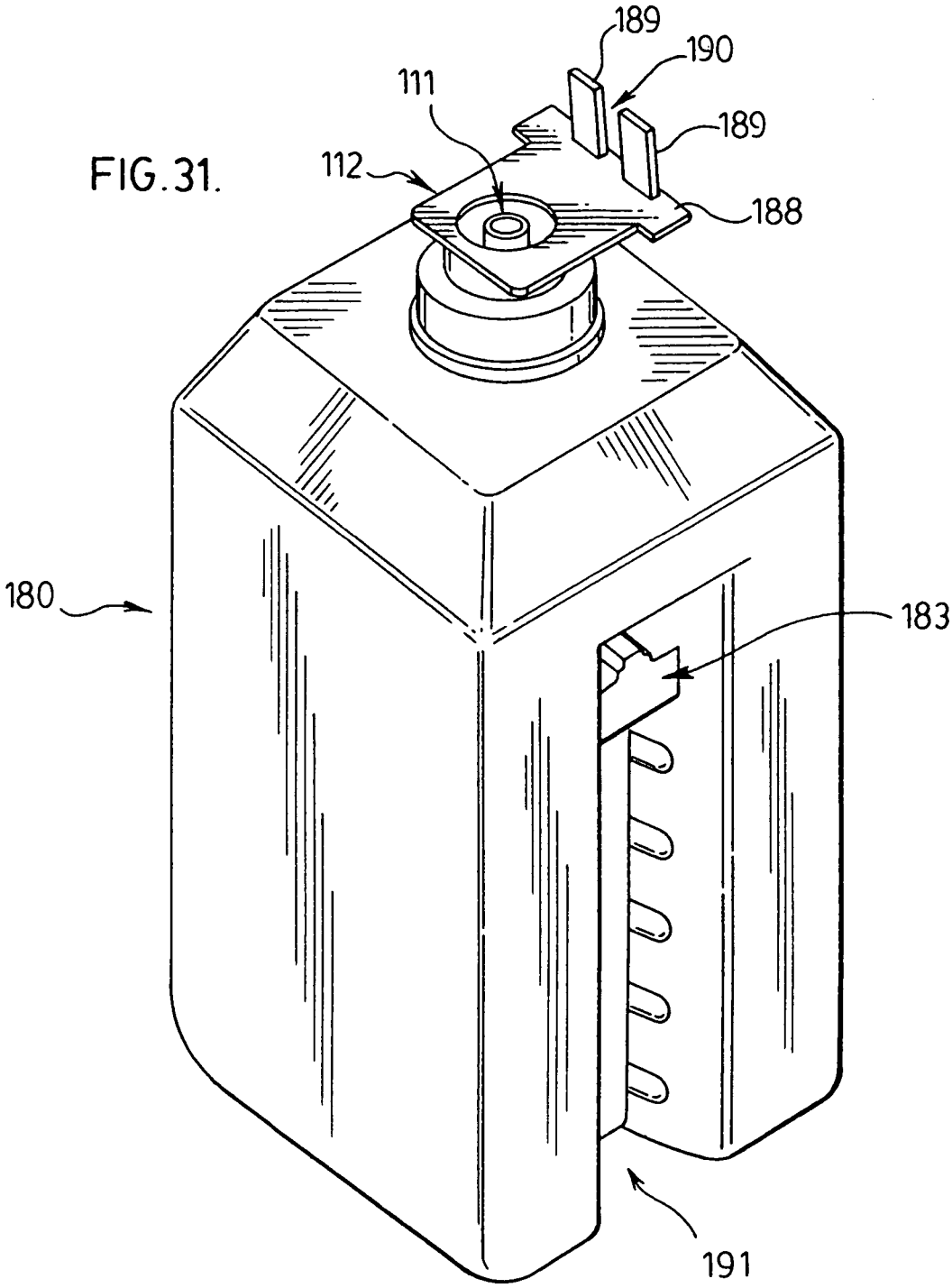
FIG. 31 is a pictorial view of the dispenser of FIG. 29 partially assembled.

Reference is made to FIGS. 29 to 31 which illustrate a soap dispenser in accordance with another embodiment of the present invention and comprising a bottle 180 which is preferably configured to be collapsible. The bottle 180 carries an upstanding neck 181 at one end providing an outlet opening 182. A piston chamber forming member 112 is adapted to be secured in the neck 81 across the outlet opening 182. A piston forming element 111 is provided substantially identical to the piston forming element shown in FIGS. 11 to 15, however, of slightly different axial proportion and with the engagement flange 136 removed. The outlet 140 of the piston forming element 111 is a cylindrical outlet tube 187.

A discharge spout 183 is provided which has a central passageway therethrough from a cylindrical inlet tube 184 to an extended length discharge tube 185 presenting a discharge outlet 186. The inlet tube 184 is adapted to be secured in a snap fit relation on the outlet tube 187 about the outlet 140 of the piston forming element 111.

In assembly, the piston chamber forming member 112 is secured on the neck 181 of the bottle 180. The piston forming element 111 is then inserted into the piston chamber forming member 112 as in the manner described with the first embodiment of FIGS. 11 to 15. The discharge spout 183 is then secured to the outlet tube 187. The piston chamber forming member 112 is provided with an integral radially outwardly extending flange 188 with two axially upwardly extending locating arms 189 providing an axial slot 190 therebetween within which the generally radially extending discharge tube 185 may be located for axial guiding against relative rotation of the discharge spout 183 about the axis 123 of the piston chamber forming member 112.

The bottle 180 illustrated in FIGS. 29 and 31 has a recess 191 in its side surface within which recess the discharge spout 183 may be removably secured, as in a snap fit, as for storage and shipping as seen in FIG. 31. The bottle 180 may preferably be a collapsible bottle, however, may be a rigid bottle with venting.

A pump in accordance with the present invention is not limited to use in dispensing from the upper end of a bottle 180 as illustrated in FIG. 29 and may be used to dispense in many different orientations, for example, from such a bottle 180 when the bottle is inverted as illustrated with the embodiment of FIGS. 11 to 15.

Figure 32:
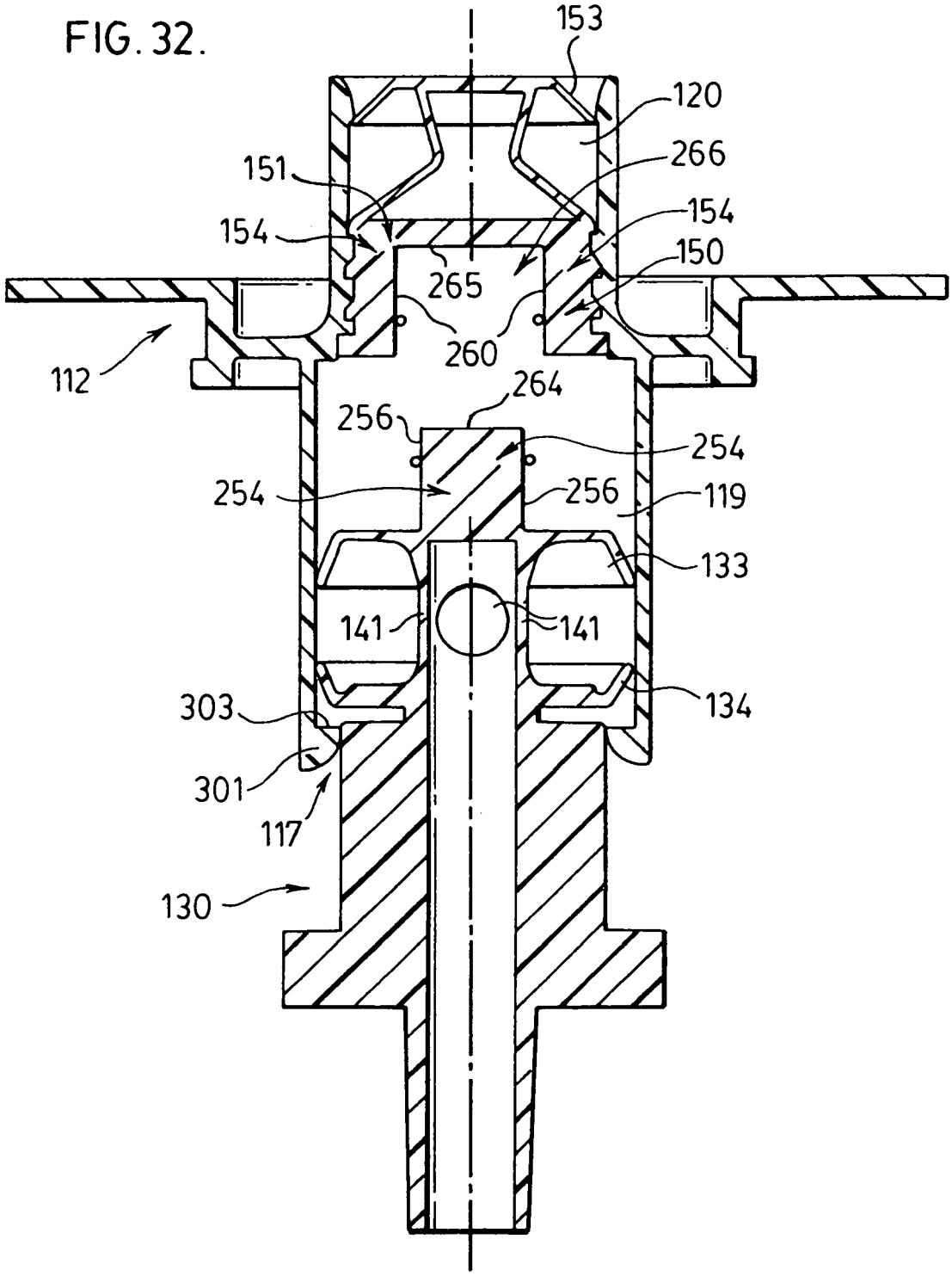
FIG. 32 is a cross-sectional side view similar to that in FIG. 34 but of a eleventh embodiment of the present invention.

Reference is made to FIG. 32 which shows an embodiment identical to that in FIGS. 23 and 24, however, which the stem 131 is provided to have four inlets 141, one on each of four diametrically opposed sides and with the thickness of the wall forming the stem 131 reduced in radial extent between the inner disc 133 and the outer disc 134 so as to provide a second frangible portion of the piston forming element for severance of the stem 131 between the first disc 133 and the second disc 134. Additionally, the piston chamber forming member 112 has about its outer open end 117 a radially inwardly directed engagement flange 301 providing an axially inwardly directed catch shoulder 303. The flange 301 preferably has an axially outwardly directed bevelled surface to assist in movement of the piston forming element 111 inwardly therepast on initial insertion. The piston may be inserted to have the locating plug 151 secured therein and the frangible connection member 160 severed as by moving the piston 130 axially inwardly relative to the detachment portion 150 and its locating plug 151. After the piston 130 is severed from the detachment portion 150, the piston is movable inwardly and outwardly but preferably not outwardly past the extended position shown in FIG. 32. If the piston 130 is attempted to be removed from the outer chamber portion 119, the outer periphery of the inner disc 133 engages the engagement shoulder 303 of the engagement flange and resists further outward movement of the piston. The engagement between the disc 133 and the flange 301 is greater than the forces required to sever the secondary frangible connection indicated as 304 to the inner disc 133 and the outer disc 134. As a result, the piston becomes severed permitting the outer portion of the disc from the frangible portion 305 to be removed and with the portion of the piston including the inner disc 133 inwardly from the frangible portion 305 being retained within the outer chamber portion 119. By severance of the piston 130 into two portions, the pump is rendered inoperable and reinsertion of the removed portion of piston 130 will not render the pump useful.

Figure 33:
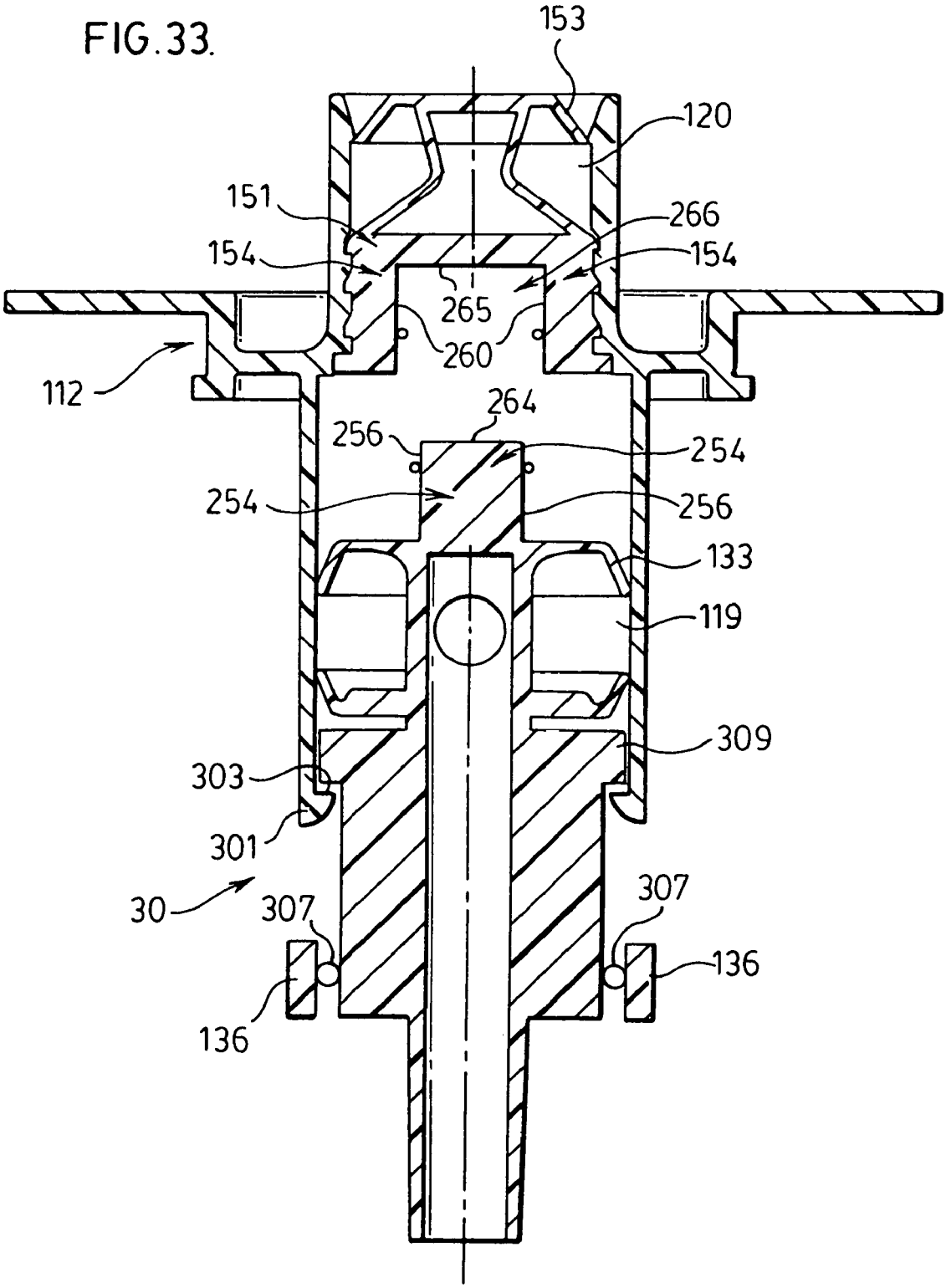
FIG. 33 is a cross-sectional side view similar to that in FIG. 24 but of a twelfth embodiment of the present invention.

Reference is made to FIG. 33 which illustrates a further embodiment of the invention whose functionality has similarities to the embodiment of FIG. 32. In the embodiment of FIG. 33, the engagement flange 136 is connected to the remainder of the piston by secondary frangible connection members 307. As is the case with FIG. 32, the outer chamber portion 119 at its outer open end 117 carries engagement flange 301 with axially inwardly directed shoulders 303. The piston 130 has its webs 135 carry a radially outwardly extending flange 309 to engage with the engagement flange 301 and resist movement of the piston 130 outwardly by forces greater than the forces required to be applied to the engagement flange 136 to break the frangible connection members 307.

The pistons of FIGS. 32 and 33 provide two locations where the piston forming element 111 may, for separate functions, separate.

Figure 34:
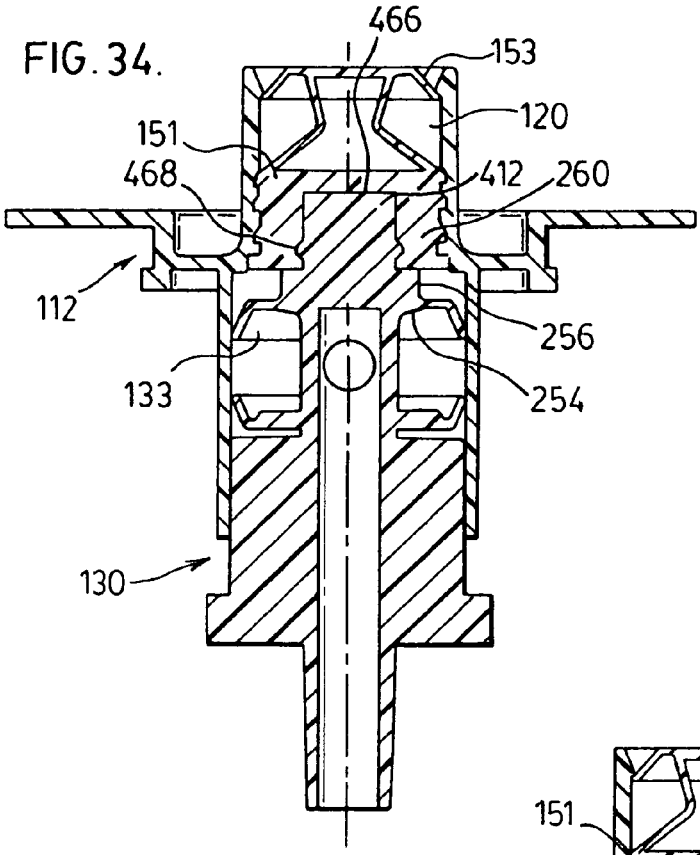
FIG. 34 is a cross-sectional side view similar to that in FIG. 23 but of a thirteenth embodiment of the present invention.
Figure 35:
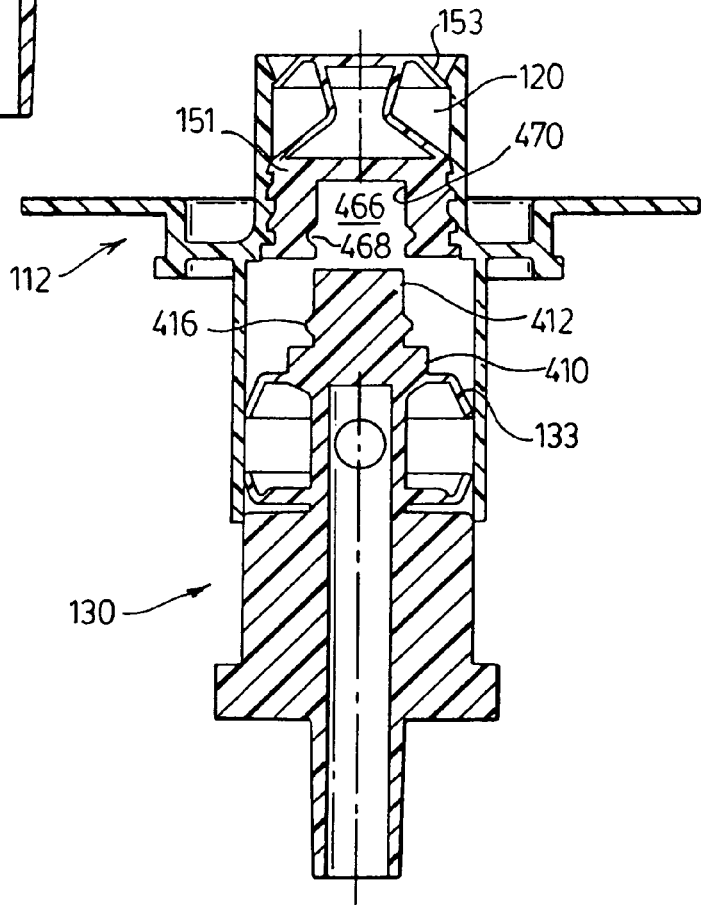
FIG. 35 is a view as in FIG. 34 but with the piston withdrawn.

Reference is made to FIGS. 34 and 35 which illustrate an embodiment similar to that shown in FIGS. 23 and 24 but in which the frangible connection mechanism is replaced by a snap fit connection mechanism. The locating plug 151 carries a generally cylindrical recess 466 with an undercut channel 468 extending radially outwardly into its side wall 470. A cylindrical stop plug 410 is carried on the inner end of the inner disc 33 of the piston 130 from which a cylindrical snap plug 412 extends coaxially. The snap plug 412 has an annular rib 416 about its circumference sized to be received in a snap fit relation inside the channel 468 in the side wall 470 of the recess 466. The snap plug 412 is shown to have a cylindrical innermost portion to coaxially locate inside the recess 466 and with an axial inner end of the recess 466.

The locating plug 151 and the piston 130 are formed as two separate elements and preferably assembled by snap fitting the two together as shown in FIG. 34.

In the fully assembled position of FIG. 34, the axially outwardly directed forces required to disengage the piston 130 from the snap fit engagement in the locating plug 151 are less than the axial forces required to disengage the locating plug 151 from the inner chamber portion 120. As a result, on drawing the piston 130 outwardly, the piston 130 severs from the locating plug 151 as seen in FIG. 35.

In use of the embodiment of FIGS. 34 and 35, preferably, the piston 130 in a cycle of operation for pumping does not move the piston 130 inwardly sufficiently that the piston 130 will again become engaged in the locating plug 151 in a snap fit relation. The piston 130 preferably assumes an initial snap fit position which is not a position through which the piston 130 moves in pumping.

Figure 36:
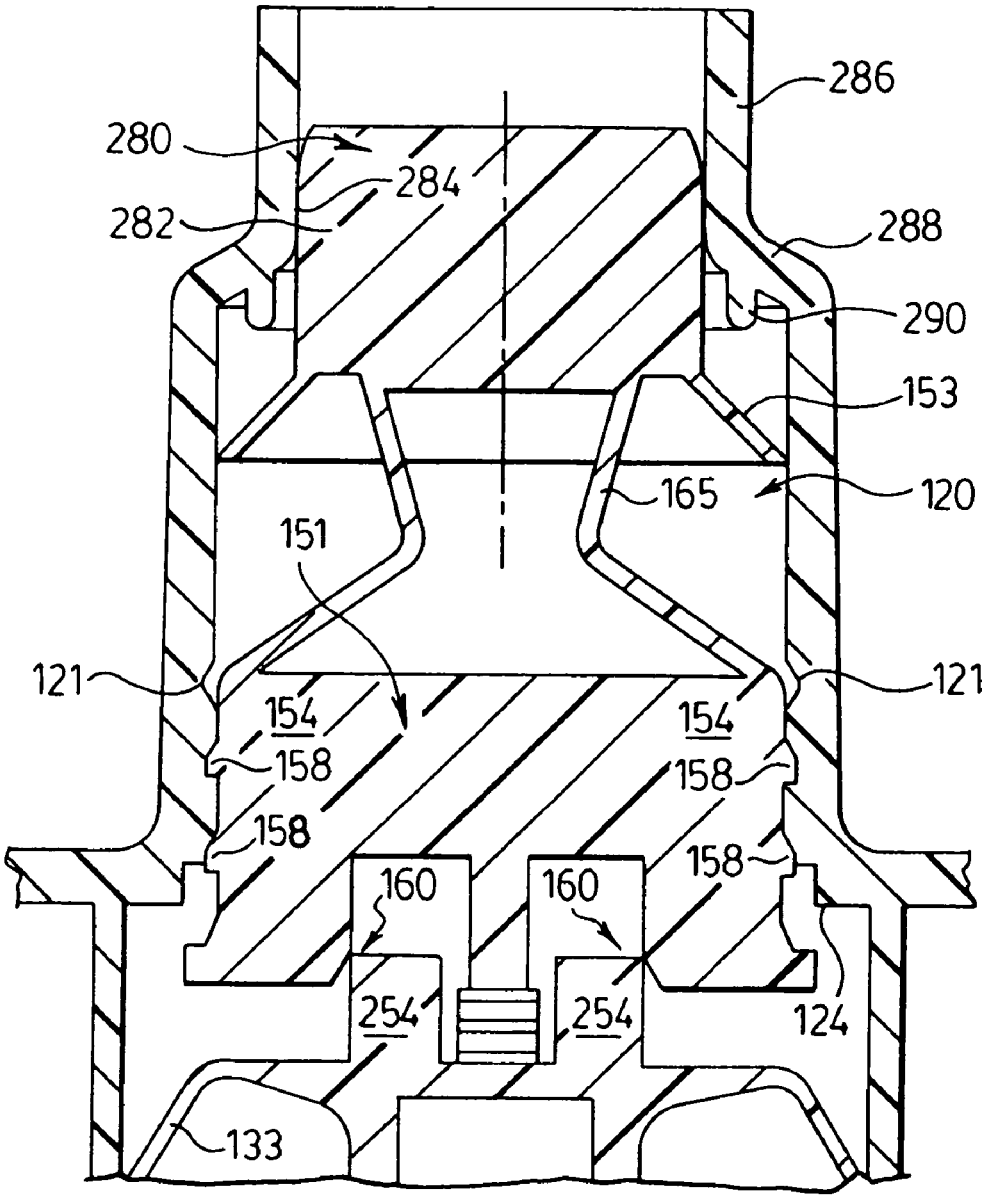
FIG. 36 is a view as in FIG. 28 but with the locating plug in an intermediate position.

Reference is made to FIG. 36 which is similar to FIG. 28 but illustrates the locating plug 151 received in an intermediate position in the inner chamber portion 120. That is, as seen in FIG. 28, the locating plug 151 is fully seated inwardly in the inner chamber portion 120 with the annular stop shoulder 124 and the detachment stop surface 162 in seated engagement and with each of the two detachment catch members 158 engaged in the innermost two annular grooves 121 of the locating plug 151.

As shown, each of the catch members 158 is similar to each of the grooves 121 and there are similar axial spacings between each. FIG. 35 shows the locating plug 151 as having been placed in an intermediate position in which the locating plug 151 has merely been forced inwardly to an extent that the innermost catch member 158 is received in the groove 121 next to the innermost of the groove 121. In this snap fit intermediate position of FIG. 36, the valve disc 153 is engaged with the side wall of the inner chamber position 120 but not with the lesser diameter annular flange 290. The valve disc 153 has a resilient outer periphery which engages the side wall of the inner chamber portion 120 to prevent fluid flow inwardly therepast and resist fluid flow outwardly therepast unless a certain first pressure differential is created across the valve disc 153. In the position of FIG. 28, the valve disc 153 engages the lesser annular flange 290 to prevent fluid flow inwardly therepast and resists fluid flow outwardly therepast unless a certain second pressure differential is created across the valve disc 153 which second pressure differential is greater than the first pressure differential. In use, the pump assembly in the intermediate configuration may be placed on a collapsible reservoir substantially filled with fluid and a vacuum applied to the outlet 140 of the piston 130 to evacuate air from the reservoir past the valve disc 153 until substantially all the air is evacuated. Evacuating air with the piston 130 in the intermediate position reduces the vacuum required to evacuate air. Preferably, such air evacuation will be as described in U.S. Pat. No. 5,489,044 to Ophardt issued Feb. 6, 1996, the disclosure of which is incorporated by reference, with evacuating being under pressures sufficiently to draw air past valve disc 153 but insufficient to draw a fluid, more viscous than air, which is in the container past the valve disc 153.

After so evacuating the air and before use in pumping, the locating plug 151 may be moved to the fully inserted position of FIG. 28 to increase the vacuum required to draw fluid past locating plug 151 and can be advantageous as for pumping of viscous creams, but disadvantageous for evacuating air.

In the embodiment of FIG. 36, where the forces required to insert the locating plug 151 to any position are less than the forces to sever the frangible connection members 160 than the extent the piston 130 is moved inwardly can be used to position and reposition the locating plug 156.

In one version of the embodiment shown in FIG. 36, the forces required to insert the locating plug 151 to the intermediate position of FIG. 36 may be less than that required to sever the frangible connection members 160, and the forces required to move the locating plug 151 inwardly from the intermediate position of FIG. 36 to the fully inserted position of FIG. 28 are greater than the axial forces which break the frangible connection members 160. However, this is not necessary.

FIG. 36 illustrates the frangible connection members 160 as having been severed as may be advantageous, for example, for the inner end of the inner disc 133 to engage the locating plug 151 and urge it to the fully inserted position shown as in initial operation of a pump activator lever.

In accordance with the aspect of the invention described with reference to FIGS. 28 and 36, the invention provides a one-way valve mechanism which is movable to two or more positions and in which positions different resistance to fluid flow outwardly therepast is provided.

Figure 37:
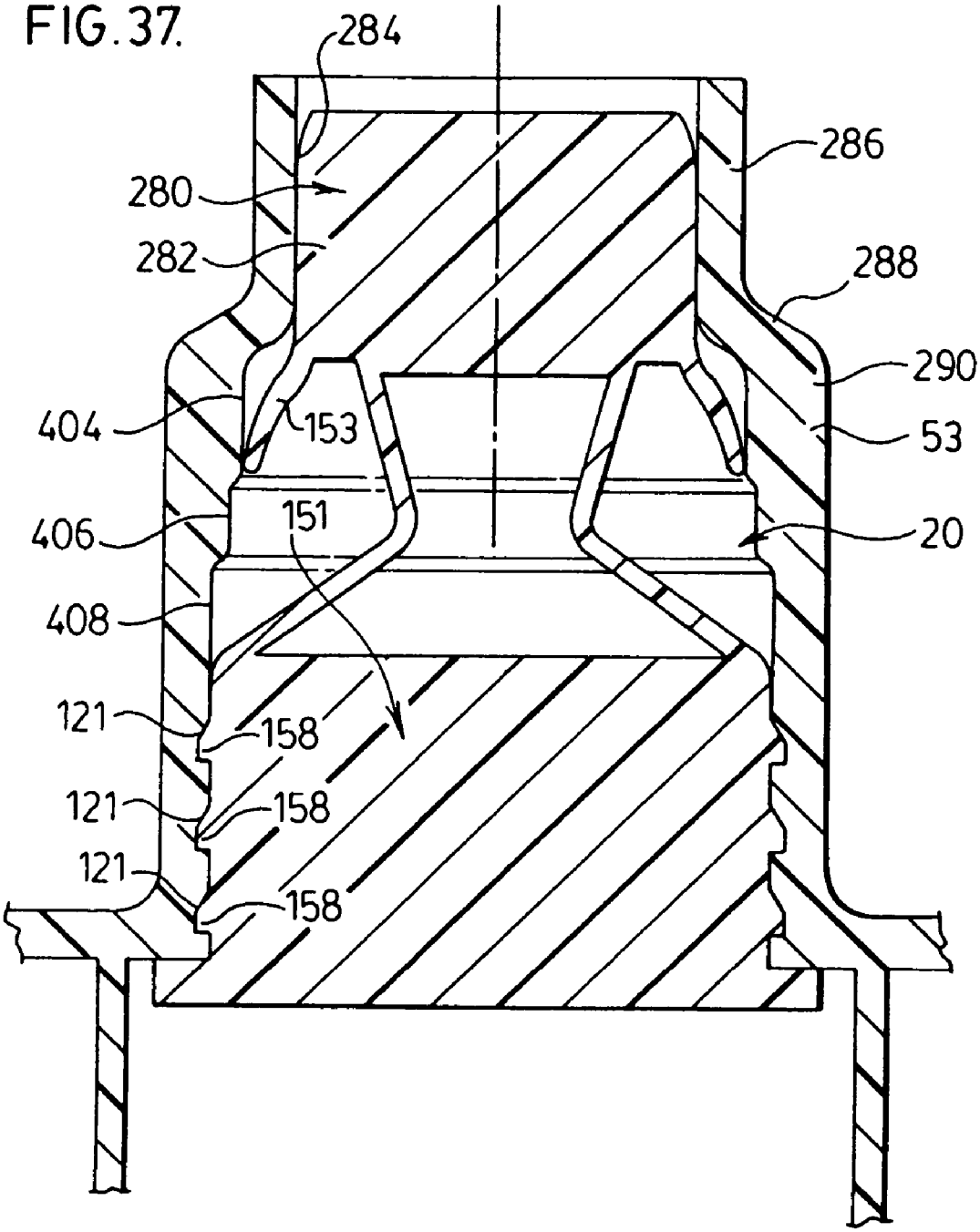
FIG. 37 is a view similar to that in FIG. 28 but of a fourteenth embodiment of the present invention.

Reference is made to FIG. 37 which illustrates as a further embodiment of the present invention, a one-way valve mechanism which has a configuration similar to that in FIGS. 28 and 36 but in which the valve merely comprises a locating plug 151 which can be located in any one of three positions in the inner chamber portion 120; an inner position shown with all three equally spaced catch members 158 in the grooves 121; an intermediate position (not shown) with only the inner two catch members 158 in the outer two grooves 121; and an outer position (not shown) with only the innermost catch member 158 in the outermost groove 121. The inner surface of the outer chamber portion 120 is stepped to increase in diameter axially outwardly such that the valve disc 153 will: resiliently engage an inner segment 404 when in the inner position, resiliently engage the intermediate segment 406 when in the intermediate position and resiliently engage the outer segment 408 when in the outer position with the resistance to flow outwardly increasing from the inner position to the outer position. The valve mechanism in FIG. 37 may be used independently without being severably coupled for insertion to a piston.

The valve of FIG. 37 could be a standard valve placed in different of the three positions in different pumps for use in pumping different fluids or for providing different pump characteristics.

An advantage of the present invention is that the resultant pump assembly as illustrated, for example, in FIG. 15 comprising three separate parts when used to pump fluid is formed merely from two parts such that merely two parts need to be handled during assembly.

In some preferred embodiments, the detachment portion 150 and the piston 130 are preferably integrally formed as a unitary element, preferably by injection moulding from plastic. This is preferred, however, is not necessary. It is possible that the detachment portion 150 and the piston 130 could be separately made and then temporarily secured together as, for example, by connection members 160 which may each represent an adhesive or snap arrangement which is frangible under forces less than forces that are required to withdraw the locating plug 151 from engagement within the chamber 114, and/or to rotate the same.

Another advantage of the present invention is that it may act as a tamper-evident indicator such that a person on inspecting a pump can determine whether or not there has been initialization of use of the pump by determining if the detachment portion 150 is secured in the chamber 114 against removal. For example, the piston pump could be provided unassembled or with the piston forming element 111 in the chamber 114 but without the piston forming element 111 having been urged inwardly to the operative position such that the detachment portion 150 is not secured within the chamber against removal and the entire piston forming element 111 can be removed.

The preferred embodiments have shown the inner first one-way valve as formed by an annular valve disc 153, a ball valve and a flapper valve. Many other arrangements of one-way valve mechanisms may be provided in which one part of the inner one-way valve is carried by the detachable portion and another part of the inner one-way valve is carried by the piston chamber forming member.

The preferred embodiments illustrate various catch mechanisms on the detachment portion 150 and catch mechanisms in the chamber 114 to permit the detachment portion 150 to be received in the chamber 114 against removal. Many different arrangements of snap fit, camming entrance features may be provided which are different than the preferred embodiments illustrated.

Figure 25:
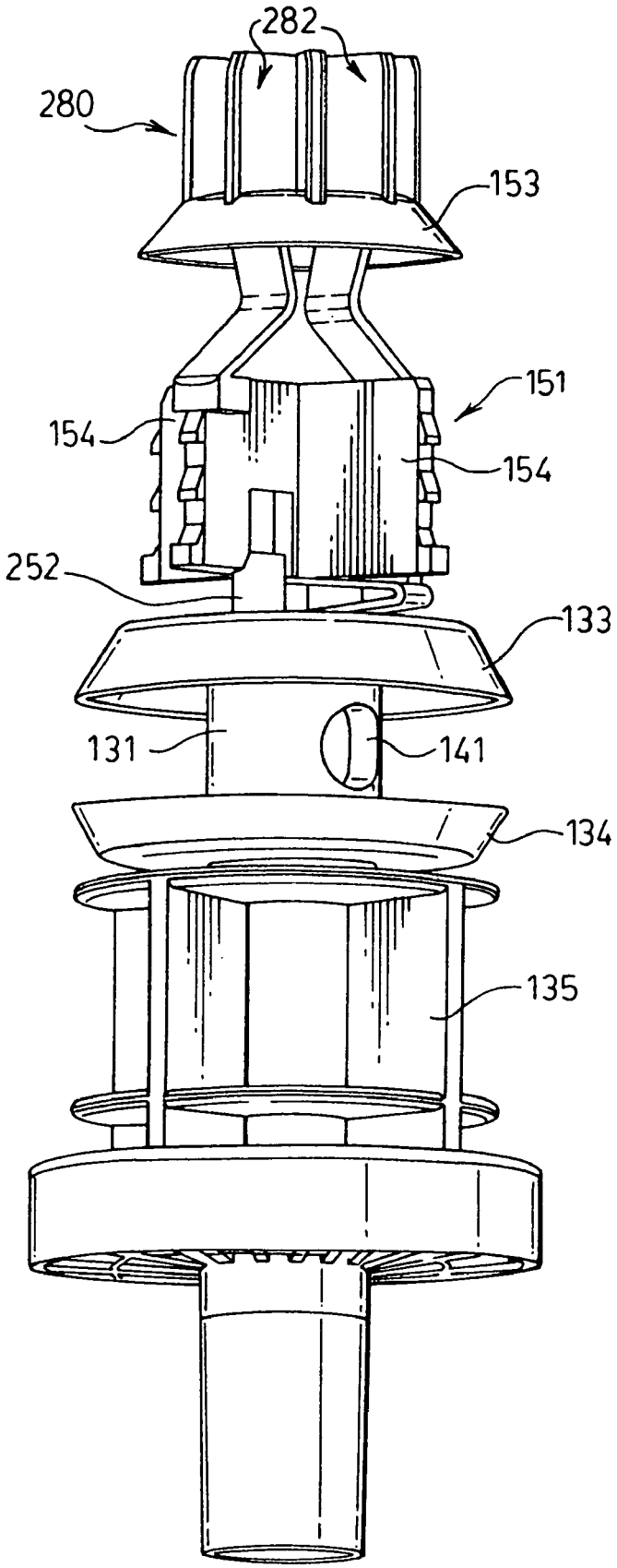
FIG. 25 is a view similar to that of FIG. 11 but of a ninth embodiment of the present invention.
Figure 26:
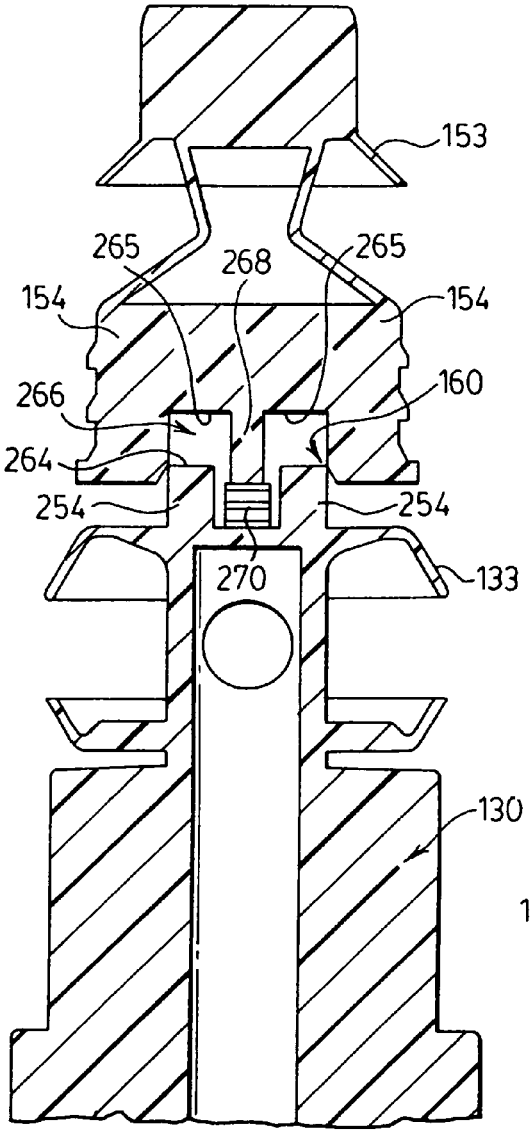
FIG. 26 is a partial cross-sectional view axially through FIG. 25 normal to the inlets to the passageway.
Figure 27:
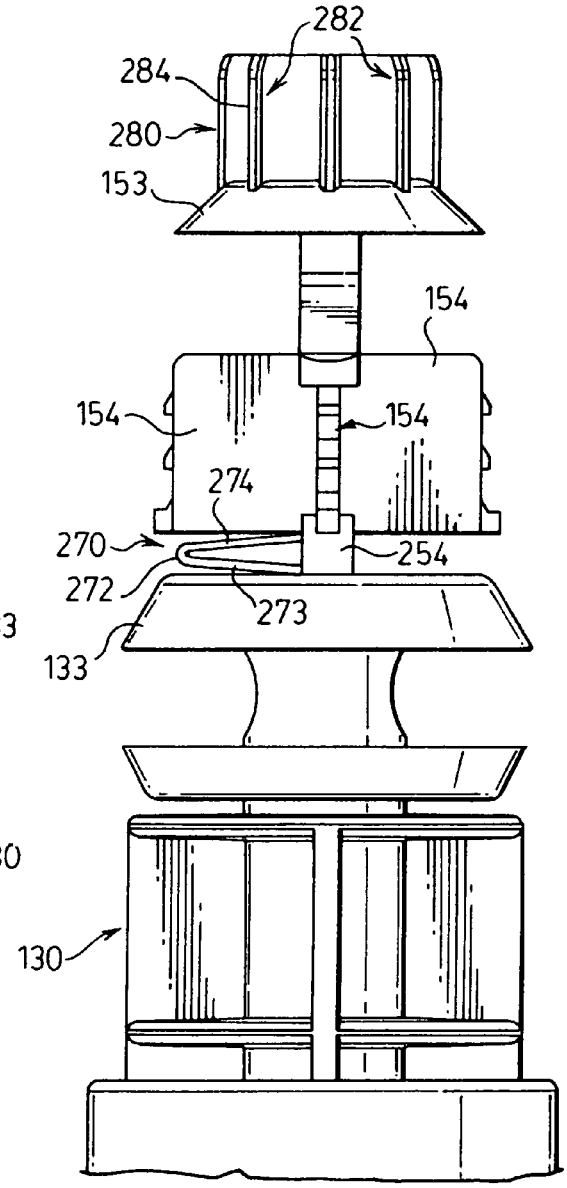
FIG. 27 is a partial cross-section along axially through FIG. 25 normal to the cross-sectional view of FIG. 26.

The embodiments of, for example, FIGS. 1 and 11 show four frangible strut or connection members and the embodiment of FIG. 25 shows two frangible connection members. Different numbers of frangible connection members including one, two and three or more may be utilized.

While the invention has been described with reference to preferred embodiments, many modifications and variations will now occur to persons skilled in the art. For a definition of the invention, reference is made to the following claims.

The invention claimed is:

1. A pump for dispensing fluids comprising:

a piston-chamber forming member having a chamber about a chamber axis, the chamber having a chamber wall, an inner end, an open outer end, an outlet and an inlet, a piston forming element received in the piston-chamber forming member axially slidable inwardly and outwardly therein between an extended position and a retracted position in cyclical operation of the pump to draw fluid into the chamber via the inlet and dispense fluid via the outlet, the piston forming element having:

an outer portion extending outwardly from the chamber through the open outer end, an inner portion in the chamber inwardly from the outer portion, an intermediate portion coupling the outer portion to the inner portion, the intermediate portion being capable of being severed such that severing of the intermediate portion severs the inner portion from the outer portion;

the piston forming element further having a piston catch member, a chamber catch member carried by the a piston-chamber forming member engaging the piston catch member when the piston forming element is moved relative the piston-chamber forming member and preventing movement of the piston catch member past the chamber catch member under forces applied to the outer portion which are equal to or greater than forces required to sever the intermediate portion.

2. A pump as claimed in claim 1 wherein the intermediate portion being frangible to sever the inner portion from the outer portion by breaking of the intermediate portion.

3. A pump as claimed in claim 2 wherein the piston catch member being inwardly from the intermediate portion, the chamber catch member engaging the piston catch member when the piston forming element is slid outwardly relative the piston-chamber forming member and preventing outward movement of the piston catch member past the chamber catch member under axially outwardly directed forces applied to the outer portion which are equal to or greater than axially outwardly directed forces required to break the intermediate portion.

4. A pump as claimed in claim 2 wherein the piston catch member being inwardly from the intermediate portion, the chamber catch member engaging the piston catch member when the piston forming element is slid inwardly relative the piston-chamber forming member and preventing inward movement of the piston catch member past the chamber catch member under axially inwardly directed forces applied to the outer portion which are equal to or greater than axially inwardly directed forces required to break the intermediate portion.

5. A pump as claimed in claim 2 wherein when the inner portion is severed from the outer portion, the pump is rendered operative for dispensing fluid on axially sliding of the piston forming element inwardly and outwardly between the extended position and the retracted position.

6. A pump as claimed in claim 2 wherein the inner portion comprises includes a valve mechanism which co-operates with the piston-chamber forming member to substantially prevent flow through the chamber at least one of inwardly and outwardly therepast.

7. A pump as claimed in claim 6 wherein the valve mechanism is a one-way valve preventing flow from the chamber inwardly through the inlet.

8. A pump as claimed in claim 2 wherein the piston catch member being inwardly from the intermediate portion, the chamber catch member engaging the piston catch member when the piston forming element is rotated about the chamber axis relative the piston-chamber forming member and preventing rotational movement of the piston catch member past the chamber catch member under rotational forces applied to the outer portion which are equal to or greater than rotational forces required to break the intermediate portion.

9. A pump as claimed in claim 1 wherein the intermediate portion being removably coupled to the inner portion by a snap fit connection from the outer portion.

10. A pump as claimed in claim 9 wherein the piston catch member being inwardly from the intermediate portion, the chamber catch member engaging the piston catch member when the piston forming element is slid outwardly relative the piston-chamber forming member and preventing outward movement of the piston catch member past the chamber catch member under axially outwardly directed forces applied to the outer portion which are equal to or greater than axially outwardly directed forces required to separate the intermediate portion from the inner portion.

11. A pump as claimed in claim 2 wherein the piston catch member being inwardly from the intermediate portion, the chamber catch member engaging the piston catch member when the piston forming element is slid outwardly relative the piston-chamber forming member at least as far as the extended position and preventing outward movement of the piston catch member past the chamber catch member under axially outwardly directed forces applied to the outer portion which are equal to or greater than axially outwardly directed forces required to break the intermediate portion, the chamber catch member extends radially inwardly into the chamber relative to the chamber wall presenting an axially inwardly directed chamber catch shoulder, the piston catch member extending radially outwardly in the chamber from the piston forming element presenting an axially outwardly directed piston catch shoulder axially inwardly of the chamber catch shoulder to engage the chamber catch shoulder.

12. A pump as claimed in claim 11 wherein the piston inner portion comprises an element selected from the group consisting of one or more of:

an element of a one way valve mechanism which resists fluid flow in the chamber in an axial direction, and a disc member which extends radially outwardly to engage the chamber wall and prevent fluid flow therepast in at least one axial direction.

13. A pump as claimed in claim 1 wherein the piston catch member carried by the inner portion, the chamber catch member engaging the piston catch member when the piston forming element is slid outwardly relative the piston-chamber forming member and preventing outward movement of the piston catch member past the chamber catch member under axially outwardly directed forces applied to the outer portion which are equal to or greater than axially outwardly directed forces required to sever the intermediate portion.

14. A pump as claimed in claim 2 wherein the piston catch member is carried on the inner portion.

15. A pump as claimed in claim 2 wherein the forces applied to the outer portion are selected from the group consisting of axially directed forces and rotational forces rotating the outer portion about the chamber axis.

16. A pump as claimed in claim 14 wherein the forces applied to the outer portion are selected from the group consisting of axially directed forces and rotational forces rotating the outer portion about the chamber axis.

17. A pump for dispensing fluid from a reservoir, comprising:

(a) a piston-chamber forming member having a cylindrical chamber, said chamber having a chamber wall, an outer open end and an inner end in fluid communication with the reservoir;

(b) first one-way valve means between the reservoir and the chamber permitting fluid flow through the inner end of said chamber from the reservoir into the chamber;

(c) a piston forming element slidably received in the chamber for reciprocal movement inwardly and outwardly in a cycle having an instroke and an outstroke, the piston forming element accessible for movement relative the piston chamber forming member through the open end of the chamber;

(d) second one-way valve means between the chamber and an outlet permitting fluid flow from the said chamber out the outlet, the piston forming element carrying a piston head which engages with the chamber wall to (i) in a first stroke, being one of the instroke and the outstroke, create pressure in the chamber between the first one-way valve means and the second one-way valve means thereby closing the first one-way valve means and displacing fluid out the second one-way valve means to the outlet and (ii) in a second stroke, being one of the instroke and the outstroke which is not the first stroke, create a vacuum in the chamber between the first one-way valve means and the second one-way valve means thereby closing the second one-way valve means and drawing fluid into the chamber from the reservoir through the first one-way valve means, the first one-way valve means including a detachment portion which is carried on the piston forming element severably secured thereto by a frangible connection member;

the detachment portion carrying detachment portion catch means, the piston-chamber forming member carrying chamber catch means in the chamber, the detachment portion catch means and chamber catch means interacting such that on initial sliding of the piston forming element with the detachment portion secured thereto into the chamber in the instroke, the detachment portion catch means and chamber catch means are placed into engagement securing the detachment portion to the chamber in a operative position which renders the first one-way valve means operable and prevents release from such securement of the detachment portion catch means from the operative position under forces applied to the detachment portion catch means through the frangible connection member greater than an identical force which will sever the frangible connection member.

18. A pump as claimed in claim 17 wherein the catch means and chamber catch means in the operative position prevent release from such securement of the detachment portion catch means from the operative position under forces, selected from the group consisting of axially outwardly directed forces and rotational forces, applied to the detachment portion catch means through the frangible connection member greater than an identical, in magnitude and direction, force which will sever the frangible connection member.

19. A pump as claimed in claim 17 wherein after initial sliding of the piston forming element with the detachment portion secured thereto into the chamber in the instroke to place the detachment portion catch means in the operative position on applying a force to the piston forming element which will sever the frangible connection member, the frangible member severs with (i) the detachment portion secured in the operative position and (ii) the piston forming element from which the detachment portion has been severed reciprocally moveable inwardly and outwardly in the cycle to pump fluid from the reservoir.

20. A pump as claimed in claim 19 wherein the piston forming element including the detachment portion consists of a unitary element formed entirely of plastic by injection moulding.

* * * * *